US009618861B2

(12) United States Patent
Fujii et al.

(10) Patent No.: US 9,618,861 B2
(45) Date of Patent: *Apr. 11, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Atsushi Fujii, Yokohama (JP); Kazuhisa Shida, Kawasaki (JP); Takashi Anezaki, Hiratsuka (JP); Haruyuki Tsuji, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 16 days.

This patent is subject to a terminal disclaimer.

(21) Appl. No.: 14/630,034

(22) Filed: Feb. 24, 2015

(65) Prior Publication Data

US 2015/0241802 A1 Aug. 27, 2015

(30) Foreign Application Priority Data

Feb. 24, 2014 (JP) ..... 2014-033340
Feb. 3, 2015 (JP) ..... 2015-019188

(51) Int. Cl.
*G03G 5/14* (2006.01)
*G03G 5/087* (2006.01)
*G03G 5/08* (2006.01)

(52) U.S. Cl.
CPC ..... *G03G 5/087* (2013.01); *G03G 5/08* (2013.01); *G03G 5/144* (2013.01)

(58) Field of Classification Search
CPC ..... G03G 5/144
USPC ..... 430/63
See application file for complete search history.

(56) References Cited

U.S. PATENT DOCUMENTS 5,171,480 A * 12/1992 Yoshinaka ..... H01B 1/20 252/500
5,488,461 A * 1/1996 Go ..... G03G 5/144 399/159
2002/0048711 A1* 4/2002 Ito ..... G03G 5/0614 430/63
2012/0121291 A1* 5/2012 Tsuji ..... G03G 5/102 399/111
2015/0212437 A1* 7/2015 Shida ..... G03G 5/142 430/56

FOREIGN PATENT DOCUMENTS

JP 2005234396 A 9/2005
JP 2010217600 A 9/2010
JP 2010224173 A 10/2010
WO WO 2014034961 A1 * 3/2014 ..... G03G 5/142

* cited by examiner

*Primary Examiner* — Christopher Rodee
(74) *Attorney, Agent, or Firm* — Canon U.S.A. Inc., IP Division

(57) ABSTRACT

A conductive layer contains a binder material, a first particle, and a second particle. The first particle is composed of a core particle and aluminum-doped zinc oxide covering the core particle or is composed of a core particle and oxygen-deficient zinc oxide covering the core particle. The second particle is of the same material as that of the core particle of the first particle. The content of the first particle is 20% by volume or more and 50% by volume or less of the total volume of the conductive layer. The content of the second particle is 0.1% by volume or more and 15% by volume or less of the total volume of the conductive layer and is 0.5% by volume or more and 30% by volume or less of the volume of the first particle.

22 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge including the electrophotographic photosensitive member, and an electrophotographic apparatus including the electrophotographic photosensitive member.

Description of the Related Art

In recent years, organic photoconductive materials (charge generation materials) have been used in electrophotographic photosensitive members that are loaded on process cartridges or electrophotographic apparatuses. The electrophotographic photosensitive member generally includes a support and a photosensitive layer disposed on the support.

The electrophotographic photosensitive member further includes a conductive layer between the support and the photosensitive layer. The conductive layer contains a metal oxide particle for covering defects on the surface of the support.

Japanese Patent Laid-Open No. 2005-234396 describes a technology for reducing image failure due to current leakage caused by addition of a combined metal oxide particle composed of a particle mainly made of a metal oxide and a surface layer mainly made of zinc oxide, to a conductive layer. The term "current leakage" refers to a phenomenon of an excessive current flow in a local portion of an electrophotographic photosensitive member, resulting from occurrence of electric breakdown at the portion.

Japanese Patent Laid-Open No. 2010-224173 describes a technology for reducing residual potential by using a conductive layer containing a titanium oxide particle covered with zinc oxide.

Unfortunately, the results of investigation by the present inventors demonstrated that in the conductive layer containing a metal oxide particle covered with zinc oxide described in the above-mentioned patent documents, application of a high voltage to the conductive layer in a low-temperature and low-humidity environment readily causes current leakage. It was also demonstrated that the above-described conductive layers are still required to reduce the occurrence of variations in dark portion potential and light portion potential during repetitive use. Occurrence of current leakage prevents the electrophotographic photosensitive member from being sufficiently charged and leads to occurrence of image defects, such as a black spot, a horizontal white streak, and a horizontal black streak, on an output image. The term "horizontal white streak" refers to a white streak occurring on an output image in the direction orthogonal to the rotation direction (circumferential direction) of the electrophotographic photosensitive member, whereas the term "horizontal black streak" refers to a black streak occurring on an output image in the direction orthogonal to the rotation direction (circumferential direction) of the electrophotographic photosensitive member.

SUMMARY OF THE INVENTION

The present invention provides an electrophotographic photosensitive member that can reduce the variations in dark portion potential and light portion potential during repetition use and hardly causes current leakage. The invention further provides a process cartridge and an electrophotographic apparatus each including the electrophotographic photosensitive member.

An aspect of the present invention provides an electrophotographic photosensitive member comprising:

a support;

a conductive layer on the support; and a photosensitive layer on the conductive layer; wherein the conductive layer comprises a binder material, a first particle, and a second particle;

the first particle is composed of a core particle coated with aluminum-doped zinc oxide;

the second particle is of the same material as that of the core particle of the first particle;

a content of the first particle in the conductive layer is 20% by volume or more and 50% by volume or less based on a total volume of the conductive layer; and a content of the second particle in the conductive layer is 0.1% by volume or more and 15% by volume or less based on the total volume of the conductive layer, and 0.5% by volume or more and 30% by volume or less based on the volume of the first particle in the conductive layer.

Another aspect of the present invention provides an electrophotographic photosensitive member comprising:

a support;

a conductive layer on the support; and a photosensitive layer on the conductive layer; wherein the conductive layer comprises a binder material, a first particle, and a second particle;

the first particle is composed of a core particle coated with oxygen-deficient zinc oxide;

the second particle is of the same material as that of the core particle of the first particle;

a content of the first particle in the conductive layer is 20% by volume or more and 50% by volume or less based on a total volume of the conductive layer; and a content of the second particle in the conductive layer is 0.1% by volume or more and 15% by volume or less based on the total volume of the conductive layer, and 0.5% by volume or more and 30% by volume or less based on the volume of the first particle in the conductive layer.

Another aspect of the present invention provides a process cartridge integrally supporting the electrophotographic photosensitive member and at least one device selected from the group consisting of charging devices, developing devices, and cleaning devices and being detachably attachable to an electrophotographic apparatus main body.

Another aspect of the present invention provides an electrophotographic apparatus comprising the electrophotographic photosensitive member and a charging device, an exposing device, a developing device, and a transferring device.

Further features of the present invention will become apparent from the following description of exemplary embodiments with reference to the attached drawings.

DESCRIPTION OF THE EMBODIMENTS

Figure 1:
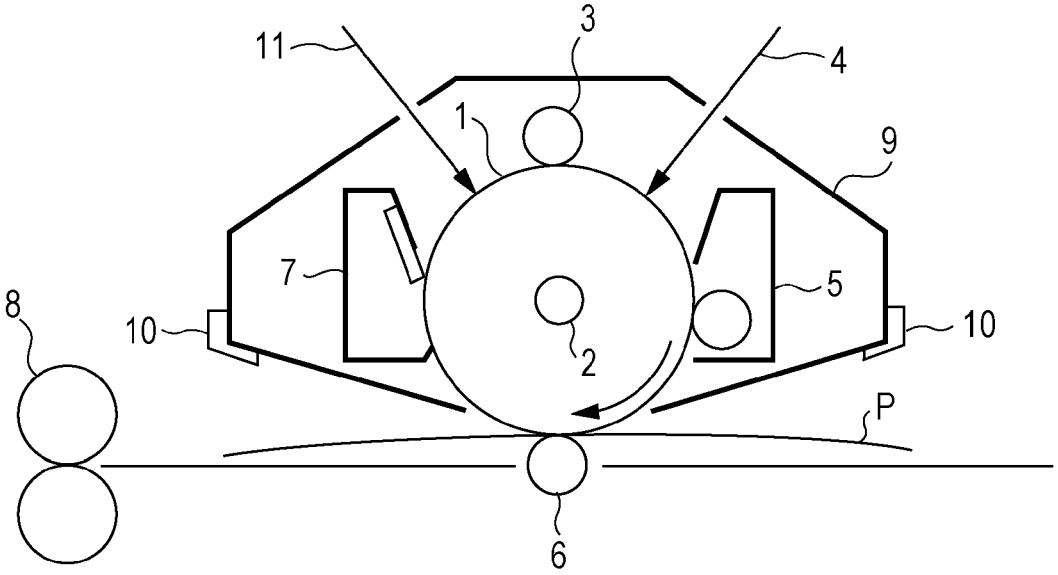
FIG. 1 is a diagram schematically illustrating an example of the structure of an electrophotographic apparatus provided with a process cartridge including an electrophotographic photosensitive member.

The electrophotographic photosensitive member of the present invention includes a support, a conductive layer on the support, and a photosensitive layer on the conductive layer.

The photosensitive layer may be a monolayer type photosensitive layer containing a charge generation material and a charge transport material in a single layer or may be a multi-layer type photosensitive layer composed of a charge generating layer containing a charge generation material and a charge transporting layer containing a charge transport material. A multi-layer type photosensitive layer can be especially used in the present invention. The electrophotographic photosensitive member optionally includes an undercoat layer between the conductive layer and the photosensitive layer.

[Support]

The support can be electrically conductive (a conductive support). For example, a metal support made of a metal, such as aluminum, an aluminum alloy, or stainless steel, can be used. A support made of aluminum or an aluminum alloy can be a tube produced by a method including an extrusion step and a drawing step or a tube produced by a method including an extrusion step and an ironing step.

[Conductive Layer]

In the present invention, a conductive layer is disposed on the support in order to cover surface defects of the support. The conductive layer contains a binder material, a first particle, and a second particle.

The first particle is a composite particle composed of a core particle coated with aluminum (Al)-doped zinc oxide (ZnO) or a composite particle composed of a core particle coated with oxygen-deficient zinc oxide (ZnO).

The second particle is of the same material (compound) as that of the core particle of the first particle. For example, when the core particle of the first particle is a titanium oxide particle, the second particle is also made of titanium oxide. When the core particle of the first particle is a tin oxide particle, the second particle is also made of tin oxide. The second particle is not coated with an inorganic material such as zinc oxide, tin oxide, or aluminum oxide, i.e., is not a composite particle, and also is not coated (not surface-treated) with an organic material such as a silane coupling agent. The second particle can be a particle not doped with aluminum.

The content of the first particle in the conductive layer is 20% by volume or more and 50% by volume or less based on the total volume of the conductive layer.

The content of the second particle in the conductive layer is 0.1% by volume or more and 15% by volume or less based on the total volume of the conductive layer and is 0.5% by volume or more and 30% by volume or less of the volume based on the first particle in the conductive layer. The content of the second particle can be 1% by volume or more and 20% by volume or less of the volume based on the first particle.

In the present invention, the conductive layer having a feature described above can reduce the variations in dark portion potential and light portion potential during repetition use and can reduce the occurrence of current leakage. This can be supposed as follows.

If the content of the first particle in the conductive layer is less than 20% by volume based on the total volume of the conductive layer, the distance among individual first particles tends to increase. The increase in the distance among individual first particles tends to raise the volume resistivity of the conductive layer. Consequently, in the image-forming period, charge is prevented from smoothly flowing, residual potential readily increases, and dark portion potential and light portion potential readily vary.

If the content of the first particle in the conductive layer is more than 50% by volume based on the total volume of the conductive layer, the individual first particles tend to be close to one another. A portion in which the individual first particles are close to one another has a locally low volume resistivity in the conductive layer, resulting in a high risk of causing current leakage in the electrophotographic photosensitive member.

Meanwhile, unlike the first particle, the second particle has a roll of reducing the occurrence of current leakage when a high voltage is applied to the electrophotographic photosensitive member in a low-temperature and low-humidity environment.

Typically, charge flowing in the conductive layer mainly flows in the surface of the first particle having a lower powder resistivity than that of the second particle. Since the first particle includes aluminum-doped zinc oxide or oxygen-deficient zinc oxide coating the core particle, the powder resistivity of the first particle is reduced to a level lower than that of the second particle. However, if the electrophotographic photosensitive member is applied with a high voltage such that excessive charge flows in the conductive layer, the charge exceeding the throughput of the surface of the first particle readily causes current leakage in the electrophotographic photosensitive member.

In the conductive layer containing the second particle of the same compound as that of the first particle, charge also flows in the surface of the second particle in addition to the surface of the first particle only when an excessive flow of charge is caused in the conductive layer. If the electrophotographic photosensitive member is applied with a high voltage such that excessive charge flows in the conductive layer, the charge flows also in the surface of the second particle, which allows the charge to more uniformly flow in the conductive layer, resulting in inhibition of current leakage from occurring.

If the content of the second particle in the conductive layer is less than 0.1% by volume based on the total volume of the conductive layer, the effect by the addition of the second particle to the conductive layer is insufficient.

If the content of the second particle in the conductive layer is more than 15% by volume based on the total volume of the conductive layer, the volume resistivity of the conductive layer is readily increased. Consequently, in the image-forming period, charge is prevented from smoothly flowing, residual potential readily increases, and dark portion potential and light portion potential readily vary.

If the content of the second particle in the conductive layer is less than 0.5% by volume based on the volume of the first particle, the effect by the addition of the second particle to the conductive layer is insufficient.

If the content of the second particle in the conductive layer is more than 30% by volume based on the volume of the first particle, the volume resistivity of the conductive layer is readily increased. Consequently, in the image-forming period, charge is prevented from smoothly flowing, residual potential readily increases, and dark portion potential and light portion potential readily vary.

It is supposed that the present invention thus reduces variations in dark portion potential and light portion potential during repetition use and prevents current leakage from occurring.

The surface of the core particle can be coated with zinc oxide by, for example, the method described in Japanese Patent Laid-Open No. 2005-234396.

Examples of the core particle of the first particle include barium sulfate particles and metal oxide particles. Especially, the core particle can be a titanium oxide particle, a zinc oxide particle, or a tin oxide particle.

The second particle may be any particle that is made of the same compound as that of the core particle of the first particle. Examples of the second particle include barium sulfate particles and metal oxide particles. Especially, the second particle can be a titanium oxide particle, a zinc oxide particle, or a tin oxide particle.

The second particle and the core particle of the first particle may be in a granular, spherical, acicular, fibrous, columnar, rod-like, fusiform, tabular, or another similar shape. Among these shapes, spherical particles can be particularly used from the viewpoint of reducing image defects such as black points.

The first particle in the conductive layer can have an average primary particle diameter ($D_1$) of 0.10 μm or more and 0.45 μm or less, in particular, 0.15 μm or more and 0.40 μm or less.

The first particle having an average primary particle diameter of 0.10 μm or more scarcely reaggregates in a conductive layer coating fluid containing the first particle. Consequently, the conductive layer coating fluid has increased stability and forms a conductive layer scarcely causing cracks in its surface.

The first particle having an average primary particle diameter of 0.45 μm or less scarcely roughens the surface of the conductive layer. Consequently, local injection of charge into the photosensitive layer scarcely occurs, and black points are prevented from occurring on a white portion of an output image.

The ratio ($D_1/D_2$) of the average primary particle diameter ($D_1$) of the first particle to the average primary particle diameter ($D_2$) of the second particle in the conductive layer can be 0.7 or more and 1.3 or less, in particular, 1.0 or more and 1.3 or less.

If the ratio ($D_1/D_2$) is 0.7 or more, the average primary particle diameter of the second particle is not too large compared to that of the first particle, resulting in a further reduction in the variations of dark portion potential and light portion potential. If the ratio ($D_1/D_2$) is not higher than 1.3, the average primary particle diameter of the second particle is not too small compared to that of the first particle, resulting in a further reduction in the occurrence of current leakage.

In the present invention, the contents and the average primary particle diameters of the first particle and the second particle in the conductive layer can be determined by three-dimensional structural analysis based on element mapping using a focused ion beam/scanning electron microscope (FIB-SEM) and slice-and-view in FIB-SEM.

The proportion (coverage) of zinc oxide covering (coating) the first particle can be 10% to 60% by mass based on the mass of the first particle. In the present invention, the coverage of zinc oxide on the first particle is determined without considering the mass of aluminum doped in the zinc oxide.

The first particle can have a powder resistivity of $1.0\times10^0$ Ω·cm or more and $1.0\times10^6$ Ω·cm or less, in particular, $1.0\times10^1$ Ω·cm or more and $1.0\times10^5$ Ω·cm or less.

The second particle can have a powder resistivity of $1.0\times10^5$ Ω·cm or more and $1.0\times10^{10}$ Ω·cm or less, in particular, $1.0\times10^6$ Ω·cm or more and $1.0\times10^9$ Ω·cm or less.

The amount (doping rate) of aluminum doped in zinc oxide of the first particle can be 0.1% to 10% by mass based on the mass of zinc oxide. The mass of zinc oxide is that of zinc oxide not including aluminum.

The conductive layer can have a volume resistivity of $1.0\times10^8$ Ω·cm or more and $5.0\times10^{12}$ Ω·cm or less. A volume resistivity of the conductive layer of $5.0\times10^{12}$ Ω·cm or less allows smooth flow of charge, prevents the residual potential from increasing, and prevents the dark portion potential and the light portion potential from varying, whereas a volume resistivity of the conductive layer of $1.0\times10^8$ Ω·cm or more can appropriately control the amount of charge flowing in the conductive layer during the electrophotographic photosensitive member being charged and prevents current leakage from occurring.

Figure 3:
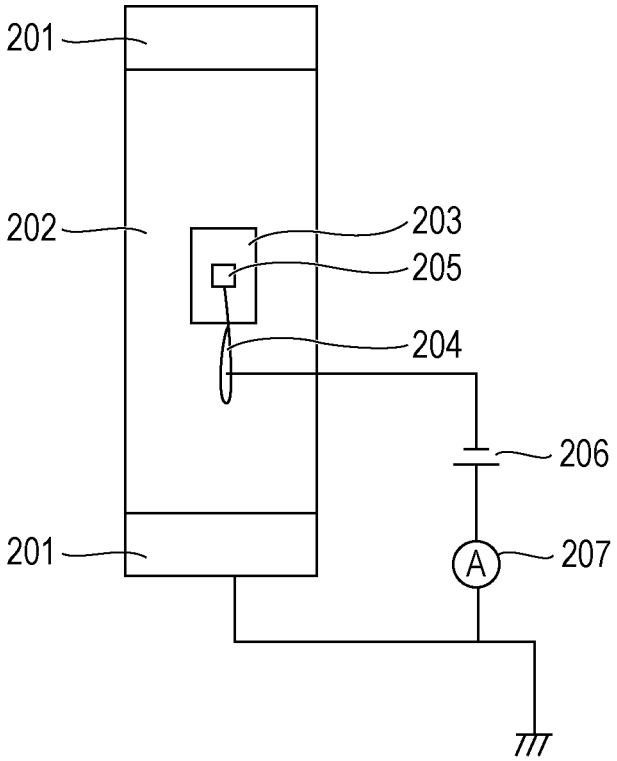
FIG. 3 is a diagram (top view) for describing a method of measuring the volume resistivity of a conductive layer.
Figure 4:
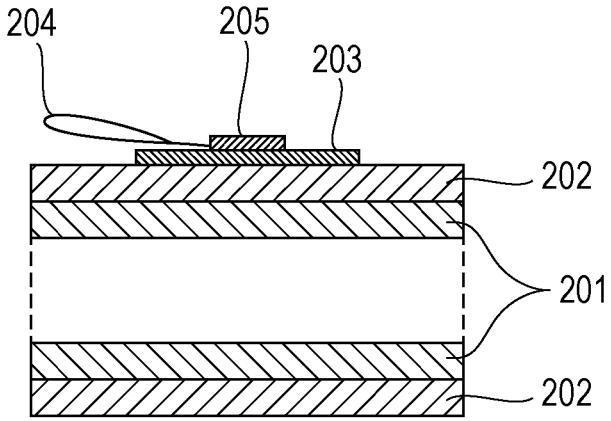
FIG. 4 is a diagram (cross-section view) for describing the method of measuring the volume resistivity of a conductive layer.
Figure 5:
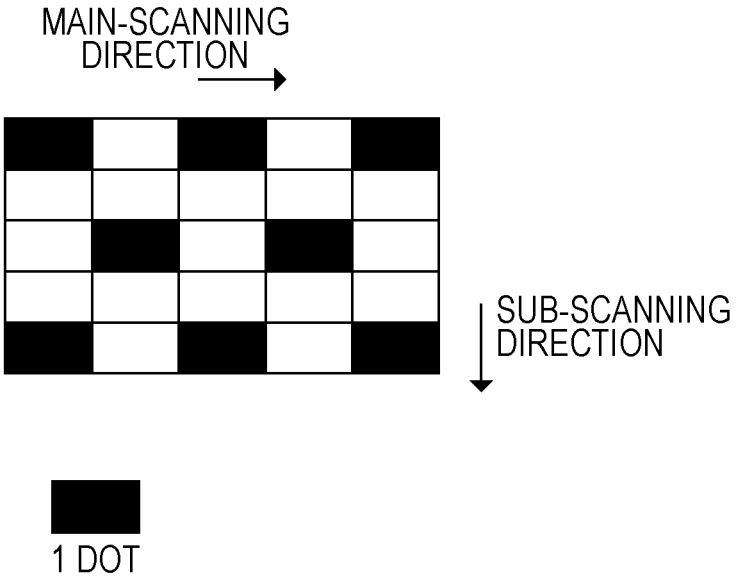
FIG. 5 is a diagram for describing a similar knight jump pattern image.

A method of measuring the volume resistivity of the conductive layer of an electrophotographic photosensitive member will be described with reference to FIGS. 3 and 4. FIG. 3 is a top view for describing a method of measuring the volume resistivity of a conductive layer. FIG. 4 is a cross-section view for describing the method of measuring the volume resistivity of a conductive layer.

The volume resistivity of a conductive layer is measured in an ordinary temperature and ordinary humidity (23° C./50% RH) environment. Copper tape 203 (manufactured by 3M Japan Limited, Model No. 1181) is attached to a surface of a conductive layer 202 and is used as the electrode on the front surface side of the conductive layer 202. The support 201 is used as the electrode on the back surface side of the conductive layer 202. A power supply 206 for applying a voltage between the copper tape 203 and the support 201 and an ammeter 207 for measuring the current flowing between the copper tape 203 and the support 201 are installed. Copper wire 204 is placed on the copper tape 203 for applying a voltage to the copper tape 203. Copper tape 205, which is the same material as that of the copper tape 203, is attached on the copper wire 204 to fix the copper wire 204 not to protrude from the copper tape 203. The copper tape 203 is applied with a voltage through the copper wire 204.

The value of volume resistivity ρ (Ω·cm) of the conductive layer 202 is defined by the following Expression (1):

$$\rho=1/(I-I_0)\times S/d \ (\Omega\cdot\text{cm}) \quad (1)$$

where $I_0$ represents the background current value (A) when no voltage is applied between the copper tape 203 and the support 201; I represents the current value (A) when only DC voltage (direct current component) of −1 V is applied; d represents the thickness (cm) of the conductive layer 202; and S represents the area S ($cm^2$) of the electrode (copper tape 203) on the front surface side of the conductive layer 202.

In this measurement, minute current values, such as $1\times10^{-6}$ A or less as the absolute value, are measured. Accordingly, an ammeter that can measure such a minute current is used as the ammeter 207. An example of the ammeter is a pA meter (trade name: 4140B) manufactured by Hewlett-Packard Japan, Ltd.

The volume resistivity measured for a conductive layer prepared by forming only the conductive layer on a support is substantially the same as that measured for a conductive layer prepared by peeling off all layers (photosensitive layer and other layers) above the conductive layer from an electrophotographic photosensitive member.

The powder resistivities of the first particle and the second particle are measured as follows.

The powder resistivities of the first particle and the second particle are measured in an ordinary temperature and ordinary humidity (23° C./50% RH) environment. In the present invention, a resistivity meter (trade name: Roresta GP) manufactured by Mitsubishi Chemical Corporation is used as the measuring apparatus, and a pellet sample is prepared by hardening the first particles or the second particles to be measured with a pressure of 500 kg/cm$^2$. The applied voltage is 100 V.

The conductive layer can be formed by applying a conductive layer coating fluid containing a solvent, a binder material, a first particle, and a second particle onto a support to form a coating film and drying and/or curing the coating film.

The conductive layer coating fluid can be prepared by dispersing the first particle and the second particle in the solvent together with the binder material. The dispersing can be performed by a method using, for example, a paint shaker, a sand mill, a ball mill, or a liquid collision-type high-speed disperser.

Examples of the binder material used for preparing the conductive layer coating fluid include resins such as phenolic resins, polyurethanes, polyamides, polyimides, polyamideimides, polyvinyl acetal, epoxy resins, acrylic resins, melamine resins, and polyesters. These resins may be used alone or in combination. Among these resins, from the viewpoints of inhibiting migration (penetration) to another layer and increasing the dispersibility and dispersion stability of the first particle and the second particle, a curable resin, in particular, a thermosetting resin can be used. In thermosetting resins, in particular, a thermosetting phenolic resin or thermosetting polyurethane can be used. When a curable resin is used as the binder material in the conductive layer, a monomer and/or oligomer of the curable resin is used as the binder material contained in the conductive layer coating fluid.

Examples of the solvent contained in the conductive layer coating fluid include alcohols such as methanol, ethanol, and isopropanol; ketones such as acetone, methyl ethyl ketone, and cyclohexane; ethers such as tetrahydrofuran, dioxane, ethylene glycol monomethyl ether, and propylene glycol monomethyl ether; esters such as methyl acetate and ethyl acetate; and aromatic hydrocarbons such as toluene and xylene.

The conductive layer can have a thickness of 10 μm or more and 40 μm or less, in particular, 15 μm or more and 35 μm or less, from the viewpoint of covering surface defects of the support.

In the present invention, the thicknesses of the layers, including the conductive layer, of the electrophotographic photosensitive member are measured with FISCHERSCOPE MMS manufactured by Fischer Instruments K.K.

In order to inhibit occurrence of interference fringes in an output image due to interference of light reflected on the surface of the conductive layer, the conductive layer may contain a surface roughening material. The surface roughening material can be a resin particle having an average particle diameter of 1 μm or more and 5 μm or less. Examples of the resin particle include particles of curable resins such as curable rubber, polyurethanes, epoxy resins, alkyd resins, phenolic resins, polyesters, silicone resins, and acrylic-melamine resins. Among these resins, a particle of a silicone resin hardly causes aggregation and can be particularly used. Since the resin particle has a small density (0.5 to 2 g/cm$^3$) compared to the density of (4 to 8 g/cm$^3$) of the first particle, the surface of the conductive layer can be efficiently roughened during the formation of the conductive layer. The content of the surface roughening material in the conductive layer can be 1% to 80% by mass of the amount of the binder material in the conductive layer.

The densities (g/cm$^3$) of particles such as the first particle, the second particle, the binder material (if the binder resin is a liquid, the binder material is cured and is then subjected to measurement), and silicone particle are measured with a dry-process automatic densitometer as follows. Particles as a measuring object are pretreated by helium gas purging at a maximum pressure of 19.5 psig for ten times with a dry-process automatic densitometer (trade name: Accupyc 1330) manufactured by Shimadzu Corporation at 23° C. using a container having a capacity of 10 cm$^3$. Subsequently, the internal pressure of the container is equilibrated until the variation in internal pressure becomes 0.0050 psig/min or less, which is a reference value of establishment of equilibrated internal pressure of a sample chamber, and the automatic measurement of the density (g/cm$^3$) is then started. The density of the first particle can be adjusted by means of the amount of zinc oxide covering the core particle or the type of the compound (material) of the core particle. The density of the second particle can be similarly adjusted by means of the type or crystal form of the compound.

The conductive layer may contain a leveling agent for increasing the surface properties of the conductive layer.

[Undercoat Layer]

An undercoat layer having an electrical barrier properties may be disposed between the conductive layer and the photosensitive layer for preventing charge injection from the conductive layer to the photosensitive layer.

The undercoat layer can be formed by applying an undercoat layer coating fluid containing a resin (binder resin) onto the conductive layer to form a coating film and drying the coating film.

Examples of the resin (binder resin) used for the undercoat layer include polyvinyl alcohol, polyvinyl methyl ether, polyacrylic acids, methyl cellulose, ethyl cellulose, polyglutamic acid, casein, polyamides, polyimides, polyamideimides, polyamic acid, melamine resins, epoxy resins, polyurethanes, and polyglutamates. Among these resins, in order to efficiently express the electrical barrier properties of the undercoat layer, a thermoplastic resin can be used. In thermoplastic resins, a thermoplastic polyamide, in particular, copolymer nylon can be used.

The undercoat layer can have a thickness of 0.1 μm or more and 2 μm or less. The undercoat layer may contain an electron transport material (electron receptive material such as acceptor) for allowing smooth flow of charge in the undercoat layer.

Examples of the electron transport material include electron attractive materials, such as 2,4,7-trinitrofluorenone, 2,4,5,7-tetranitrofluorenone, chloranil, and tetracyanoquinodimethane, and polymerized materials of these electron attractive materials.

[Photosensitive Layer]

A photosensitive layer is disposed on the conductive layer or the undercoat layer.

Examples of the charge generation material used for the photosensitive layer includes azo pigments, phthalocyanine pigments, indigo pigments, perylene pigments, polycyclic quinone pigments, squarylium colorants, pyrylium salts, thiapyrylium salts, triphenylmethane colorants, quinacridone pigments, azulenium salt pigments, cyanine dyes, xanthene colorants, quinonimine colorants, and styryl colorants. Among these materials, in particular, a metal phthalocyanine, such as oxytitanium phthalocyanine, hydroxy gallium phthalocyanine, or chlorogalium phthalocyanine, can be used.

When the photosensitive layer is of a multi-layer type, a charge generating layer can be formed by applying a charge generating layer coating fluid to form a coating film and drying the coating film. The charge generating layer coating fluid is prepared by dispersing a charge generation material in a solvent together with a binder resin. The dispersing can be performed by a method using, for example, a homogenizer, ultrasonic waves, a ball mill, a sand mill, an attritor, or a roll mill.

Examples of the binder resin used for the charge generating layer include polycarbonates, polyesters, polyacrylates, butyral resins, polystyrene, polyvinyl acetal, diallylphthalate resins, acrylic resins, methacrylic resins, vinyl acetate resins, phenolic resins, silicone resins, polystyrene, styrene-butadiene copolymers, alkyd resins, epoxy resins, urea resins, and vinyl chloride-vinyl acetate copolymers. These binder resins may be used alone or a mixture or copolymer of two or more thereof.

The mass ratio of the charge generation material and the binder resin (charge generation material: binder resin) can be within a range of 10:1 to 1:10, in particular, 5:1 to 1:1.

Examples of the solvent contained in the charge generating layer coating fluid include alcohols, sulfoxides, ketones, ethers, esters, aliphatic halogenated hydrocarbons, and aromatic compounds.

The charge generating layer can have a thickness of 5 μm or less, in particular, 0.1 μm or more and 2 μm or less.

The charge generating layer can optionally contain various additives such as a sensitizer, an antioxidant, an ultraviolet absorber, and a plasticizer. The charge generating layer may contain an electron transport material (electron receptive material such as acceptor) for allowing smooth flow of charge in the charge generating layer.

The electron transport material contained in the charge generating layer can be the same compound as that in the undercoat layer.

Examples of the charge transport material contained in the photosensitive layer include triarylamine compounds, hydrazone compounds, styryl compounds, stilbene compounds, pyrazoline compounds, oxazole compounds, thiazole compounds, and triallylmethane compounds.

When the photosensitive layer is of a multi-layer type, a charge transporting layer can be formed by preparing a charge transporting layer coating fluid by dissolving a charge transport material and a binder resin in a solvent, applying the charge transporting layer coating fluid to form a coating film, and drying the coating film.

Examples of the binder resin contained in the charge transporting layer include acrylic resins, styrene resins, polyesters, polycarbonates, polyacrylates, polysulfones, polyphenylene oxide, epoxy resins, polyurethane, and alkyd resins. These binder resins may be used alone or a mixture or copolymer of two or more thereof.

The mass ratio of the charge transport material and the binder resin (charge transport material: binder resin) can be within a range of 2:1 to 1:2.

Examples of the solvent contained in the charge transporting layer coating fluid include ketone solvents, ester solvents, ether solvents, aromatic hydrocarbon solvents, and halogen-substituted hydrocarbon solvents.

The charge transporting layer can have a thickness of 3 μm or more and 40 μm or less, in particular, 4 μm or more and 30 μm or less.

The charge transporting layer can optionally contain an antioxidant, an ultraviolet absorber, or a plasticizer.

When the photosensitive layer is of a monolayer type, the monolayer type photosensitive layer can be formed by applying a monolayer type photosensitive layer coating fluid to form a coating film and drying the coating film. The monolayer type photosensitive layer coating fluid contains a charge generation material, a charge transport material, a binder resin, and a solvent. The charge generation material, the charge transport material, the binder resin, and the solvent can be, for example, the same as those mentioned above.

On the photosensitive layer, a protective layer may be disposed for protecting the photosensitive layer.

The protective layer can be formed by applying a protective layer coating fluid containing a resin (binder resin) to form a coating film and drying and/or curing the coating film.

The protective layer can have a thickness of 0.5 μm or more and 10 μm or less, in particular, 1 μm or more and 8 μm or less.

Each of the coating fluids for the above-described layers can be applied by, for example, immersion coating, spray coating, spinner coating, roller coating, Meyer bar coating, or blade coating.

FIG. 1 schematically illustrates an example of the structure of an electrophotographic apparatus provided with a process cartridge including an electrophotographic photosensitive member.

In FIG. 1, the drum-shaped (cylindrical) electrophotographic photosensitive member 1 is rotary-driven around the shaft 2 as the rotation center in the direction indicated by the arrow at a predetermined peripheral velocity.

The surface (peripheral surface) of the electrophotographic photosensitive member 1 that is rotary-driven is uniformly charged to a predetermined positive or negative potential with a charging device (primary charging device, such as a charging roller) 3. Subsequently, the surface is exposed to light (image exposure light) 4 emitted from an exposing device (not shown), a slit exposure device, or a laser beam scanning exposure device. Thus, electrostatic latent images corresponding to objective images are serially formed on the peripheral surface of the electrophotographic photosensitive member 1. The voltage applied to the charging device 3 may be DC voltage only or may be DC voltage superimposed with AC voltage.

The electrostatic latent image formed on the peripheral surface of the electrophotographic photosensitive member 1 is developed by the toner of the developing device 5 into a toner image. Subsequently, the toner image formed on the peripheral surface of the electrophotographic photosensitive member 1 is transferred to a transfer medium (such as paper) P with a transfer bias from a transferring device (such as transfer roller) 6. The transfer medium P is fed to a contact portion between the electrophotographic photosensitive member 1 and the transferring device 6 from a transfer medium supply unit (not shown) in synchronization with the rotation of the electrophotographic photosensitive member 1.

The transfer medium P received the transferred toner image is detached from the peripheral surface of the electrophotographic photosensitive member 1 and is then introduced into a fixing device 8. The transfer medium receives image fixing treatment from the fixing device 8 and is put out to the outside of the apparatus as an image-formed product (e.g., printed matter or copied matter).

The peripheral surface of the electrophotographic photosensitive member 1 after the transfer of the toner image is subjected to removal of the toner remaining on the surface with a cleaning device (such as cleaning blade) 7. The peripheral surface of the electrophotographic photosensitive member 1 is further neutralized with pre-exposing light 11 from a pre-exposing device (not shown) and is repeatedly used for image formation. When the charging device is of a contact type such as a charging roller, pre-exposure is not essential.

The above-described electrophotographic photosensitive member 1 and at least one of the charging device 3, the developing device 5, and the cleaning device 7 can be put in a container to provide a process cartridge integrally supporting them. This process cartridge can be configured to be detachably attachable to an electrophotographic apparatus main body. The process cartridge 9 shown in FIG. 1 integrally supports the electrophotographic photosensitive member 1 and the charging device 3, developing device 5, and cleaning device 7 and is detachably attachable to an electrophotographic apparatus main body with a guiding device 10, such as a rail, of the electrophotographic apparatus main body.

EXAMPLES

The present invention will now be described in more detail by examples, but should not be limited thereto. Note that "part(s)" in examples and comparative examples means "part(s) by mass". The particle size distributions of the particles in examples and comparative examples each exhibited one peak.

Preparation Examples of Conductive Layer Coating Fluid

Preparation Example

Conductive Layer Coating Fluid 1

A sand mill was charged with 115 parts of first particles, 10 parts of second particles, 168 parts of a binder material, and 98 parts of 1-methoxy-2-propanol serving as a solvent. The mixture was subjected to dispersion treatment using 420 parts of glass beads having a diameter of 0.8 mm at a rotation speed of 1500 rpm for 4 hours to prepare a dispersion. The first particles were titanium oxide particles covered with aluminum-doped zinc oxide (powder resistivity: $5.0\times10^2$ Ω·cm, average primary particle diameter: 0.20 μm, density: 4.6 g/cm$^3$, powder resistivity of the core particle (titanium oxide particle): $5.0\times10^7$ Ω·cm, average primary particle diameter of the core particle (titanium oxide particle): 0.18 μm, density of the core particle (titanium oxide particle): 4.0 g/cm$^3$); the second particles were titanium oxide particles (powder resistivity: $5.0\times10^7$ Ω·cm, average primary particle diameter: 0.20 μm, density: 4.0 g/cm$^3$); and the binder material was a phenolic resin (monomer/oligomer of a phenolic resin) (trade name: Plyophen J-325, manufactured by DIC Corporation, resin solid content: 60%, density after curing: 1.3 g/cm$^3$).

The glass beads were removed from the resulting dispersion with a mesh filter. To the dispersion after the removal of the glass beads were added 13.8 parts of silicone resin particles serving as a surface roughening material (trade name: Tospearl 120, manufactured by Momentive Performance Materials Inc., average particle diameter: 2 μm, density: 1.3 g/cm$^3$), 0.014 parts of silicone oil serving as a leveling agent (trade name: SH28PA, manufactured by Dow Corning Toray Co., Ltd.), 6 parts of methanol, and 6 parts of 1-methoxy-2-propanol. The mixture was stirred to prepare conductive layer coating fluid 1.

Preparation Examples

Conductive Layer Coating Fluids 2 to 114 and C1 to C72

Conductive layer coating fluids 2 to 114 and C1 to C72 were prepared as in the preparation of conductive layer coating fluid 1 except that the types, average primary particle diameters, and amounts (parts) of the first particles and the second particles used were those shown in Tables 1 to 5; in conductive layer coating fluids 18, 36, and 54, the dispersion treatment was conducted at a rotation speed of 2500 rpm for 20 hours; in conductive layer coating fluids 2 to 18, 55 to 66, and C1 to C18, the second particles were titanium oxide particles (density: 4.0 g/cm$^3$); in conductive layer coating fluids 19 to 36, 67 to 78, and C19 to C36, the second particles were zinc oxide particles (density: 5.6 g/cm$^3$); in conductive layer coating fluids 37 to 54, 79 to 90, and C37 to C54, the second particles were tin oxide particles (density: 6.6 g/cm$^3$); and in conductive layer coating fluids 91 to 114 and C55 to C72, the second particles were barium sulfate particles (density: 4.5 g/cm$^3$).

TABLE 1

| Conductive | First particle | | | | Second particle | | Binder material (Phenolic resin) Amount [parts] |
|---|---|---|---|---|---|---|---|
| layer coating fluid | Type | Powder resistivity [Ω · cm] | Average primary particle diameter [μm] | Amount [parts] | Average primary particle diameter [μm] | Amount [parts] | (including a resin solid content of 60% by mass) |
| 1 | Titanium oxide | $5.0 \times 10^2$ | 0.20 | 115 | 0.20 | 10 | 168 |
| 2 | particle covered | $5.0 \times 10^2$ | 0.20 | 115 | 0.20 | 28 | 168 |
| 3 | with Al-doped | $5.0 \times 10^2$ | 0.20 | 115 | 0.20 | 29 | 168 |
| 4 | zinc oxide | $5.0 \times 10^2$ | 0.20 | 105 | 0.20 | 0.5 | 168 |
| 5 | Density: | $5.0 \times 10^2$ | 0.20 | 290 | 0.20 | 23 | 168 |
| 6 | 4.6 g/cm$^3$ | $5.0 \times 10^2$ | 0.20 | 430 | 0.20 | 51 | 168 |
| 7 | | $5.0 \times 10^2$ | 0.20 | 430 | 0.20 | 26 | 168 |
| 8 | | $5.0 \times 10^2$ | 0.20 | 290 | 0.20 | 38 | 168 |
| 9 | | $5.0 \times 10^2$ | 0.20 | 290 | 0.20 | 69 | 168 |
| 10 | | $5.0 \times 10^2$ | 0.20 | 430 | 0.20 | 102 | 168 |

TABLE 1-continued

| Conductive layer coating fluid | First particle Type | Powder resistivity [Ω · cm] | Average primary particle diameter [μm] | Amount [parts] | Second particle Average primary particle diameter [μm] | Amount [parts] | Binder material (Phenolic resin) Amount [parts] (including a resin solid content of 60% by mass) |
|---|---|---|---|---|---|---|---|
| 11 | | $5.0 \times 10^2$ | 0.20 | 540 | 0.20 | 140 | 168 |
| 12 | | $5.0 \times 10^2$ | 0.45 | 290 | 0.20 | 14 | 168 |
| 13 | | $5.0 \times 10^2$ | 0.45 | 290 | 0.40 | 14 | 168 |
| 14 | | $5.0 \times 10^2$ | 0.15 | 290 | 0.15 | 14 | 168 |
| 15 | | $5.0 \times 10^2$ | 0.15 | 290 | 0.10 | 14 | 168 |
| 16 | | $2.0 \times 10^2$ | 0.20 | 290 | 0.20 | 23 | 168 |
| 17 | | $1.5 \times 10^3$ | 0.20 | 290 | 0.20 | 23 | 168 |
| 18 | | $5.0 \times 10^2$ | 0.20 | 160 | 0.20 | 12 | 168 |
| 19 | Zinc oxide | $5.0 \times 10^2$ | 0.20 | 135 | 0.20 | 12 | 168 |
| 20 | particle covered | $5.0 \times 10^2$ | 0.20 | 135 | 0.20 | 30 | 168 |
| 21 | with Al-doped | $5.0 \times 10^2$ | 0.20 | 135 | 0.20 | 31 | 168 |
| 22 | zinc oxide | $5.0 \times 10^2$ | 0.20 | 125 | 0.20 | 0.8 | 168 |
| 23 | Density: | $5.0 \times 10^2$ | 0.20 | 310 | 0.20 | 25 | 168 |
| 24 | 5.6 g/cm$^3$ | $5.0 \times 10^2$ | 0.20 | 450 | 0.20 | 53 | 168 |
| 25 | | $5.0 \times 10^2$ | 0.20 | 450 | 0.20 | 28 | 168 |
| 26 | | $5.0 \times 10^2$ | 0.20 | 310 | 0.20 | 40 | 168 |
| 27 | | $5.0 \times 10^2$ | 0.20 | 310 | 0.20 | 71 | 168 |
| 28 | | $5.0 \times 10^2$ | 0.20 | 450 | 0.20 | 104 | 168 |
| 29 | | $5.0 \times 10^2$ | 0.20 | 650 | 0.20 | 195 | 168 |
| 30 | | $5.0 \times 10^2$ | 0.45 | 310 | 0.20 | 16 | 168 |
| 31 | | $5.0 \times 10^2$ | 0.45 | 310 | 0.40 | 16 | 168 |
| 32 | | $5.0 \times 10^2$ | 0.15 | 310 | 0.15 | 17 | 168 |
| 33 | | $5.0 \times 10^2$ | 0.15 | 310 | 0.10 | 17 | 168 |
| 34 | | $2.0 \times 10^2$ | 0.20 | 310 | 0.20 | 25 | 168 |
| 35 | | $1.5 \times 10^3$ | 0.20 | 310 | 0.20 | 25 | 168 |
| 36 | | $5.0 \times 10^2$ | 0.20 | 180 | 0.20 | 14 | 168 |
| 37 | Tin oxide | $5.0 \times 10^2$ | 0.20 | 160 | 0.20 | 14 | 168 |
| 38 | particle covered | $5.0 \times 10^2$ | 0.20 | 160 | 0.20 | 35 | 168 |
| 39 | with Al-doped | $5.0 \times 10^2$ | 0.20 | 160 | 0.20 | 35 | 168 |
| 40 | zinc oxide | $5.0 \times 10^2$ | 0.20 | 140 | 0.20 | 0.9 | 168 |
| 41 | Density: | $5.0 \times 10^2$ | 0.20 | 330 | 0.20 | 27 | 168 |
| 42 | 6.2 g/cm$^3$ | $5.0 \times 10^2$ | 0.20 | 470 | 0.20 | 55 | 168 |
| 43 | | $5.0 \times 10^2$ | 0.20 | 470 | 0.20 | 30 | 168 |
| 44 | | $5.0 \times 10^2$ | 0.20 | 330 | 0.20 | 42 | 168 |
| 45 | | $5.0 \times 10^2$ | 0.20 | 330 | 0.20 | 73 | 168 |
| 46 | | $5.0 \times 10^2$ | 0.20 | 470 | 0.20 | 111 | 168 |
| 47 | | $5.0 \times 10^2$ | 0.20 | 750 | 0.20 | 225 | 168 |
| 48 | | $5.0 \times 10^2$ | 0.45 | 330 | 0.20 | 18 | 168 |
| 49 | | $5.0 \times 10^2$ | 0.45 | 330 | 0.40 | 18 | 168 |
| 50 | | $5.0 \times 10^2$ | 0.15 | 330 | 0.15 | 19 | 168 |
| 51 | | $5.0 \times 10^2$ | 0.15 | 330 | 0.10 | 19 | 168 |
| 52 | | $2.0 \times 10^2$ | 0.20 | 330 | 0.20 | 27 | 168 |
| 53 | | $1.5 \times 10^3$ | 0.20 | 330 | 0.20 | 27 | 168 |
| 54 | | $5.0 \times 10^2$ | 0.20 | 200 | 0.20 | 16 | 168 |

TABLE 2

| Conductive layer coating fluid | First particle Type | Powder resistivity [Ω · cm] | Average primary particle diameter [μm] | Amount [parts] | Second particle Average primary particle diameter [μm] | Amount [parts] | Binder material (Phenolic resin) Amount [parts] (including a resin solid content of 60% by mass) |
|---|---|---|---|---|---|---|---|
| 55 | Titanium oxide | $5.0 \times 10^2$ | 0.20 | 103 | 0.20 | 0.5 | 168 |
| 56 | particle | $5.0 \times 10^2$ | 0.20 | 300 | 0.20 | 14 | 168 |
| 57 | covered with | $5.0 \times 10^2$ | 0.20 | 300 | 0.20 | 23 | 168 |
| 58 | oxygen- | $5.0 \times 10^2$ | 0.20 | 460 | 0.20 | 50 | 168 |
| 59 | deficient | $5.0 \times 10^2$ | 0.20 | 300 | 0.20 | 38 | 168 |
| 60 | zinc oxide | $5.0 \times 10^2$ | 0.20 | 300 | 0.20 | 68 | 168 |
| 61 | Density: | $5.0 \times 10^2$ | 0.20 | 520 | 0.20 | 100 | 168 |
| 62 | 4.6 g/cm$^3$ | $5.0 \times 10^2$ | 0.20 | 560 | 0.20 | 145 | 168 |
| 63 | | $5.0 \times 10^2$ | 0.45 | 300 | 0.20 | 23 | 168 |
| 64 | | $5.0 \times 10^2$ | 0.45 | 300 | 0.40 | 23 | 168 |
| 65 | | $5.0 \times 10^2$ | 0.15 | 300 | 0.15 | 23 | 168 |
| 66 | | $5.0 \times 10^2$ | 0.15 | 300 | 0.10 | 23 | 168 |
| 67 | Zinc oxide | $5.0 \times 10^2$ | 0.20 | 125 | 0.20 | 0.6 | 168 |
| 68 | particle | $5.0 \times 10^2$ | 0.20 | 320 | 0.20 | 15 | 168 |

TABLE 2-continued

| Conductive layer coating fluid | First particle Type | First particle Powder resistivity [Ω · cm] | First particle Average primary particle diameter [μm] | First particle Amount [parts] | Second particle Average primary particle diameter [μm] | Second particle Amount [parts] | Binder material (Phenolic resin) Amount [parts] (including a resin solid content of 60% by mass) |
|---|---|---|---|---|---|---|---|
| 69 | covered with | $5.0 \times 10^2$ | 0.20 | 320 | 0.20 | 24 | 168 |
| 70 | oxygen- | $5.0 \times 10^2$ | 0.20 | 540 | 0.20 | 55 | 168 |
| 71 | deficient | $5.0 \times 10^2$ | 0.20 | 320 | 0.20 | 40 | 168 |
| 72 | zinc oxide | $5.0 \times 10^2$ | 0.20 | 320 | 0.20 | 70 | 168 |
| 73 | Density: | $5.0 \times 10^2$ | 0.20 | 560 | 0.20 | 120 | 168 |
| 74 | 5.6 g/cm$^3$ | $5.0 \times 10^2$ | 0.20 | 600 | 0.20 | 180 | 168 |
| 75 | | $5.0 \times 10^2$ | 0.45 | 320 | 0.20 | 25 | 168 |
| 76 | | $5.0 \times 10^2$ | 0.45 | 320 | 0.40 | 25 | 168 |
| 77 | | $5.0 \times 10^2$ | 0.15 | 320 | 0.15 | 25 | 168 |
| 78 | | $5.0 \times 10^2$ | 0.15 | 320 | 0.10 | 25 | 168 |
| 79 | Tin oxide | $5.0 \times 10^2$ | 0.20 | 145 | 0.20 | 0.8 | 168 |
| 80 | particle | $5.0 \times 10^2$ | 0.20 | 340 | 0.20 | 17 | 168 |
| 81 | covered with | $5.0 \times 10^2$ | 0.20 | 340 | 0.20 | 26 | 168 |
| 82 | oxygen- | $5.0 \times 10^2$ | 0.20 | 570 | 0.20 | 27 | 168 |
| 83 | deficient | $5.0 \times 10^2$ | 0.20 | 340 | 0.20 | 42 | 168 |
| 84 | zinc oxide | $5.0 \times 10^2$ | 0.20 | 340 | 0.20 | 75 | 168 |
| 85 | Density: | $5.0 \times 10^2$ | 0.20 | 580 | 0.20 | 130 | 168 |
| 86 | 6.2 g/cm$^3$ | $5.0 \times 10^2$ | 0.20 | 700 | 0.20 | 220 | 168 |
| 87 | | $5.0 \times 10^2$ | 0.45 | 340 | 0.20 | 27 | 168 |
| 88 | | $5.0 \times 10^2$ | 0.45 | 340 | 0.40 | 27 | 168 |
| 89 | | $5.0 \times 10^2$ | 0.15 | 340 | 0.15 | 27 | 168 |
| 90 | | $5.0 \times 10^2$ | 0.15 | 340 | 0.10 | 27 | 168 |

TABLE 3

| Conductive layer coating fluid | First particle Type | First particle Powder resistivity [Ω · cm] | First particle Average primary particle diameter [μm] | First particle Amount [parts] | Second particle Average primary particle diameter [μm] | Second particle Amount [parts] | Binder material (Phenolic resin) Amount [parts] (including a resin solid content of 60% by mass) |
|---|---|---|---|---|---|---|---|
| 91 | Barium sulfate | $5.0 \times 10^2$ | 0.20 | 115 | 0.20 | 0.6 | 168 |
| 92 | particle | $5.0 \times 10^2$ | 0.20 | 310 | 0.20 | 15 | 168 |
| 93 | covered with | $5.0 \times 10^2$ | 0.20 | 310 | 0.20 | 24 | 168 |
| 94 | Al-doped | $5.0 \times 10^2$ | 0.20 | 465 | 0.20 | 24 | 168 |
| 95 | zinc oxide | $5.0 \times 10^2$ | 0.20 | 310 | 0.20 | 38 | 168 |
| 96 | Density: | $5.0 \times 10^2$ | 0.20 | 310 | 0.20 | 70 | 168 |
| 97 | 5.0 g/cm$^3$ | $5.0 \times 10^2$ | 0.20 | 550 | 0.20 | 115 | 168 |
| 98 | | $5.0 \times 10^2$ | 0.20 | 620 | 0.20 | 165 | 168 |
| 99 | | $5.0 \times 10^2$ | 0.45 | 310 | 0.20 | 25 | 168 |
| 100 | | $5.0 \times 10^2$ | 0.45 | 310 | 0.40 | 25 | 168 |
| 101 | | $5.0 \times 10^2$ | 0.15 | 310 | 0.15 | 25 | 168 |
| 102 | | $5.0 \times 10^2$ | 0.15 | 310 | 0.10 | 25 | 168 |
| 103 | Barium sulfate | $5.0 \times 10^2$ | 0.20 | 115 | 0.20 | 0.6 | 168 |
| 104 | particle | $5.0 \times 10^2$ | 0.20 | 310 | 0.20 | 15 | 168 |
| 105 | covered with | $5.0 \times 10^2$ | 0.20 | 310 | 0.20 | 24 | 168 |
| 106 | oxygen- | $5.0 \times 10^2$ | 0.20 | 465 | 0.20 | 24 | 168 |
| 107 | deficient | $5.0 \times 10^2$ | 0.20 | 310 | 0.20 | 38 | 168 |
| 108 | zinc oxide | $5.0 \times 10^2$ | 0.20 | 310 | 0.20 | 70 | 168 |
| 109 | Density: | $5.0 \times 10^2$ | 0.20 | 550 | 0.20 | 115 | 168 |
| 110 | 5.0 g/cm$^3$ | $5.0 \times 10^2$ | 0.20 | 620 | 0.20 | 165 | 168 |
| 111 | | $5.0 \times 10^2$ | 0.45 | 310 | 0.20 | 25 | 168 |
| 112 | | $5.0 \times 10^2$ | 0.45 | 310 | 0.40 | 25 | 168 |
| 113 | | $5.0 \times 10^2$ | 0.15 | 310 | 0.15 | 25 | 168 |
| 114 | | $5.0 \times 10^2$ | 0.15 | 310 | 0.10 | 25 | 168 |

TABLE 4

| Conductive layer coating fluid | First particle Type | Powder resistivity [Ω · cm] | Average primary particle diameter [μm] | Amount [parts] | Second particle Average primary particle diameter [μm] | Second particle Amount [parts] | Binder material (Phenolic resin) Amount [parts] (including a resin solid content of 60% by mass) |
|---|---|---|---|---|---|---|---|
| C1 | Titanium oxide | $5.0 \times 10^2$ | 0.20 | 100 | 0.20 | 8 | 168 |
| C2 | particle | $5.0 \times 10^2$ | 0.20 | 480 | 0.20 | 50 | 168 |
| C3 | covered with | $5.0 \times 10^2$ | 0.20 | 250 | Not used | | 168 |
| C4 | Al-doped | $5.0 \times 10^2$ | 0.20 | 250 | 0.20 | 0.2 | 168 |
| C5 | zinc oxide | $5.0 \times 10^2$ | 0.20 | 420 | 0.20 | 0.3 | 168 |
| C6 | Density: | $5.0 \times 10^2$ | 0.20 | 250 | 0.20 | 110 | 168 |
| C7 | 4.6 g/cm$^3$ | $5.0 \times 10^2$ | 0.20 | 510 | 0.20 | 150 | 168 |
| C8 | | $5.0 \times 10^2$ | 0.20 | 250 | 0.20 | 0.8 | 168 |
| C9 | | $5.0 \times 10^2$ | 0.20 | 250 | 0.20 | 68 | 168 |
| C10 | Titanium oxide | $5.0 \times 10^2$ | 0.20 | 100 | 0.20 | 8 | 168 |
| C11 | particle | $5.0 \times 10^2$ | 0.20 | 480 | 0.20 | 50 | 168 |
| C12 | covered with | $5.0 \times 10^2$ | 0.20 | 250 | Not used | | 168 |
| C13 | oxygen- | $5.0 \times 10^2$ | 0.20 | 250 | 0.20 | 0.2 | 168 |
| C14 | deficient | $5.0 \times 10^2$ | 0.20 | 420 | 0.20 | 0.3 | 168 |
| C15 | zinc oxide | $5.0 \times 10^2$ | 0.20 | 250 | 0.20 | 110 | 168 |
| C16 | Density: | $5.0 \times 10^2$ | 0.20 | 510 | 0.20 | 150 | 168 |
| C17 | 4.6 g/cm$^3$ | $5.0 \times 10^2$ | 0.20 | 250 | 0.20 | 0.8 | 168 |
| C18 | | $5.0 \times 10^2$ | 0.20 | 250 | 0.20 | 68 | 168 |
| C19 | Zinc oxide | $5.0 \times 10^2$ | 0.20 | 120 | 0.20 | 8.0 | 168 |
| C20 | particle | $5.0 \times 10^2$ | 0.20 | 560 | 0.20 | 50 | 168 |
| C21 | covered with | $5.0 \times 10^2$ | 0.20 | 280 | Not used | | 168 |
| C22 | Al-doped | $5.0 \times 10^2$ | 0.20 | 280 | 0.20 | 0.3 | 168 |
| C23 | zinc oxide | $5.0 \times 10^2$ | 0.20 | 450 | 0.20 | 0.4 | 168 |
| C24 | Density: | $5.0 \times 10^2$ | 0.20 | 280 | 0.20 | 160 | 168 |
| C25 | 5.6 g/cm$^3$ | $5.0 \times 10^2$ | 0.20 | 540 | 0.20 | 200 | 168 |
| C26 | | $5.0 \times 10^2$ | 0.20 | 280 | 0.20 | 0.8 | 168 |
| C27 | | $5.0 \times 10^2$ | 0.20 | 280 | 0.20 | 93 | 168 |
| C28 | Zinc oxide | $5.0 \times 10^2$ | 0.20 | 120 | 0.20 | 8.0 | 168 |
| C29 | particle | $5.0 \times 10^2$ | 0.20 | 560 | 0.20 | 50 | 168 |
| C30 | covered with | $5.0 \times 10^2$ | 0.20 | 280 | Not used | | 168 |
| C31 | oxygen- | $5.0 \times 10^2$ | 0.20 | 280 | 0.20 | 0.3 | 168 |
| C32 | deficient | $5.0 \times 10^2$ | 0.20 | 450 | 0.20 | 0.4 | 168 |
| C33 | zinc oxide | $5.0 \times 10^2$ | 0.20 | 280 | 0.20 | 160 | 168 |
| C34 | Density: | $5.0 \times 10^2$ | 0.20 | 540 | 0.20 | 200 | 168 |
| C35 | 5.6 g/cm$^3$ | $5.0 \times 10^2$ | 0.20 | 280 | 0.20 | 0.8 | 168 |
| C36 | | $5.0 \times 10^2$ | 0.20 | 280 | 0.20 | 93 | 168 |

TABLE 5

| Conductive layer coating fluid | First particle Type | Powder resistivity [Ω · cm] | Average primary particle diameter [μm] | Amount [parts] | Second particle Average primary particle diameter [μm] | Second particle Amount [parts] | Binder material (Phenolic resin) Amount [parts] (including a resin solid content of 60% by mass) |
|---|---|---|---|---|---|---|---|
| C37 | Tin oxide | $5.0 \times 10^2$ | 0.20 | 130 | 0.20 | 8.0 | 168 |
| C38 | particle | $5.0 \times 10^2$ | 0.20 | 620 | 0.20 | 50 | 168 |
| C39 | covered with | $5.0 \times 10^2$ | 0.20 | 310 | Not used | | 168 |
| C40 | Al-doped | $5.0 \times 10^2$ | 0.20 | 310 | 0.20 | 0.4 | 168 |
| C41 | zinc oxide | $5.0 \times 10^2$ | 0.20 | 470 | 0.20 | 0.4 | 168 |
| C42 | Density: | $5.0 \times 10^2$ | 0.20 | 300 | 0.20 | 175 | 168 |
| C43 | 6.2 g/cm$^3$ | $5.0 \times 10^2$ | 0.20 | 560 | 0.20 | 230 | 168 |
| C44 | | $5.0 \times 10^2$ | 0.20 | 300 | 0.20 | 0.8 | 168 |
| C45 | | $5.0 \times 10^2$ | 0.20 | 300 | 0.20 | 100 | 168 |
| C46 | Tin oxide | $5.0 \times 10^2$ | 0.20 | 130 | 0.20 | 8.0 | 168 |
| C47 | particle | $5.0 \times 10^2$ | 0.20 | 620 | 0.20 | 50 | 168 |
| C48 | covered with | $5.0 \times 10^2$ | 0.20 | 310 | Not used | | 168 |
| C49 | oxygen- | $5.0 \times 10^2$ | 0.20 | 310 | 0.20 | 0.4 | 168 |
| C50 | deficient | $5.0 \times 10^2$ | 0.20 | 470 | 0.20 | 0.4 | 168 |
| C51 | zinc oxide | $5.0 \times 10^2$ | 0.20 | 300 | 0.20 | 175 | 168 |
| C52 | Density: | $5.0 \times 10^2$ | 0.20 | 560 | 0.20 | 230 | 168 |
| C53 | 6.2 g/cm$^3$ | $5.0 \times 10^2$ | 0.20 | 300 | 0.20 | 0.8 | 168 |
| C54 | | $5.0 \times 10^2$ | 0.20 | 300 | 0.20 | 100 | 168 |
| C55 | Barium sulfate | $5.0 \times 10^2$ | 0.20 | 100 | 0.20 | 8.0 | 168 |
| C56 | particle | $5.0 \times 10^2$ | 0.20 | 520 | 0.20 | 50 | 168 |
| C57 | covered with | $5.0 \times 10^2$ | 0.20 | 250 | Not used | | 168 |
| C58 | Al-doped | $5.0 \times 10^2$ | 0.20 | 250 | 0.20 | 0.2 | 168 |

TABLE 5-continued

| Conductive layer coating fluid | First particle Type | Powder resistivity [Ω · cm] | Average primary particle diameter [μm] | Amount [parts] | Second particle Average primary particle diameter [μm] | Amount [parts] | Binder material (Phenolic resin) Amount [parts] (including a resin solid content of 60% by mass) |
|---|---|---|---|---|---|---|---|
| C59 | zinc oxide | $5.0 \times 10^2$ | 0.20 | 440 | 0.20 | 0.2 | 168 |
| C60 | Density: | $5.0 \times 10^2$ | 0.20 | 250 | 0.20 | 120 | 168 |
| C61 | 5.0 g/cm$^3$ | $5.0 \times 10^2$ | 0.20 | 530 | 0.20 | 180 | 168 |
| C62 | | $5.0 \times 10^2$ | 0.20 | 250 | 0.20 | 0.6 | 168 |
| C63 | | $5.0 \times 10^2$ | 0.20 | 250 | 0.20 | 73 | 168 |
| C64 | Barium sulfate | $5.0 \times 10^2$ | 0.20 | 100 | 0.20 | 8.0 | 168 |
| C65 | particle | $5.0 \times 10^2$ | 0.20 | 520 | 0.20 | 50 | 168 |
| C66 | covered with | $5.0 \times 10^2$ | 0.20 | 250 | Not used | | 168 |
| C67 | oxygen- | $5.0 \times 10^2$ | 0.20 | 250 | 0.20 | 0.2 | 168 |
| C68 | deficient | $5.0 \times 10^2$ | 0.20 | 440 | 0.20 | 0.2 | 168 |
| C69 | zinc oxide | $5.0 \times 10^2$ | 0.20 | 250 | 0.20 | 120 | 168 |
| C70 | Density: | $5.0 \times 10^2$ | 0.20 | 530 | 0.20 | 180 | 168 |
| C71 | 5.0 g/cm$^3$ | $5.0 \times 10^2$ | 0.20 | 250 | 0.20 | 0.6 | 168 |
| C72 | | $5.0 \times 10^2$ | 0.20 | 250 | 0.20 | 73 | 168 |

Preparation Example

Conductive Layer Coating Fluid 115

Conductive layer coating fluid 115 was prepared as in the preparation of conductive layer coating fluid 8 except that in addition to the first particles and the second particles, 30 parts of aluminum-doped zinc oxide particles (powder resistivity: 5.0×10 Ω·cm, average primary particle diameter: 0.02 μm, density: 5.6 g/cm$^3$) were added to the fluid.

Preparation Example

Conductive Layer Coating Fluid C73

Conductive layer coating fluid C73 was prepared as in the preparation of conductive layer coating fluid 8 except that 38 parts of tin oxide particles (powder resistivity: $5.0\times10^7$ Ω·cm, average primary particle diameter: 0.20 μm, density: 6.6 g/cm$^3$) were used instead of the second particles used in the preparation of conductive layer coating fluid 8.

Preparation Example

Conductive Layer Coating Fluid C74

Conductive layer coating fluid C74 was prepared as in the preparation of conductive layer coating fluid 26 except that 40 parts of titanium oxide particles (powder resistivity: $5.0\times10^7$ Ω·cm, average primary particle diameter: 0.20 μm, density: 4.0 g/cm$^3$) were used instead of the second particles used in the preparation of conductive layer coating fluid 26.

Preparation Example

Conductive Layer Coating Fluid C75

Conductive layer coating fluid C75 was prepared as in the preparation of conductive layer coating fluid 44 except that 42 parts of zinc oxide particles (powder resistivity: $5.0\times10^7$ Ω·cm, average primary particle diameter: 0.20 μm, density: 5.6 g/cm$^3$) were used instead of the second particles used in the preparation of conductive layer coating fluid 44.

Preparation Example

Conductive Layer Coating Fluid C76

Conductive layer coating fluid C76 was prepared as in the preparation of conductive layer coating fluid 26 except that 350 parts of aluminum-doped zinc oxide particles (powder resistivity: 5.0×10 Ω·cm, average primary particle diameter: 0.20 μm, density: 5.6 g/cm$^3$) only were used instead of the first particles and the second particles used in the preparation of conductive layer coating fluid 26.

Preparation Example

Conductive Layer Coating Fluid C77

Conductive layer coating fluid C77 was prepared as in the preparation of conductive layer coating fluid 26 except that 310 parts of aluminum-doped zinc oxide particles (powder resistivity: 5.0×10 Ω·cm, average primary particle diameter: 0.20 μm, density: 5.6 g/cm$^3$) were used instead of the first particles used in the preparation of conductive layer coating fluid 26.

Preparation Example

Conductive Layer Coating Fluid C78

Conductive layer coating fluid C78 was prepared as in the preparation of conductive layer coating fluid 8 except that 160 parts of zinc oxide particles (powder resistivity: $5.0\times10^7$ Ω·cm, average primary particle diameter: 0.20 μm, density: 5.6 g/cm$^3$) and 160 parts of tin oxide particles (powder resistivity: $5.0\times10^7$ Ω·cm, average primary particle diameter: 0.20 μm, density: 6.6 g/cm$^3$) were used instead of the first particles and the second particles used in the preparation of conductive layer coating fluid 8.

Preparation Example

Conductive Layer Coating Fluid C79

Conductive layer coating fluid C79 was prepared as in the preparation of conductive layer coating fluid 8 except that 160 parts of zinc oxide particles (powder resistivity: $5.0\times10^7$ Ω·cm, average primary particle diameter: 0.20 μm, density: 5.6 g/cm$^3$) and 160 parts of titanium oxide particles (powder resistivity: $5.0\times10^7$ Ω·cm, average primary particle diameter: 0.20 μm, density: 4.0 g/cm$^3$) were used instead of the first particles and the second particles used in the preparation of conductive layer coating fluid 8.

Preparation Example

Conductive Layer Coating Fluid C80

Conductive layer coating fluid C80 was prepared as in the preparation of conductive layer coating fluid 26 except that 350 parts of combined metal oxide particles 1 (particles each composed of a titanium oxide particle and a zinc oxide layer on the titanium oxide particle) described in Japanese Patent Laid-Open No. 2005-234396 were used instead of the first particles and the second particles used in the preparation of conductive layer coating fluid 26.

Preparation Example

Conductive Layer Coating Fluid C81

Conductive layer coating fluid C81 was prepared as in the preparation of conductive layer coating fluid 26 except that 350 parts of combined metal oxide particles 2 (particles each composed of a titanium oxide particle and a zinc oxide layer covering the surface of the titanium oxide particle) described in Japanese Patent Laid-Open No. 2005-234396 were used instead of the first particles and the second particles used in the preparation of conductive layer coating fluid 26.

Preparation Example

Conductive Layer Coating Fluid C82

Conductive layer coating fluid C82 was prepared as in the preparation of conductive layer coating fluid 26 except that 350 parts of titanium oxide particles 1 not surface-treated with the silane coupling agent described in Japanese Patent Laid-Open No. 2010-224173 were used instead of the first particles and the second particles used in the preparation of conductive layer coating fluid 26.

Preparation Example

Conductive Layer Coating Fluid C83

Conductive layer coating fluid C83 was prepared as in the preparation of conductive layer coating fluid 26 except that 350 parts of titanium oxide particles 4 not surface-treated with the silane coupling agent described in Japanese Patent Laid-Open No. 2010-224173 were used instead of the first particles and the second particles used in the preparation of conductive layer coating fluid 26.

Production Examples of Electrophotographic Photosensitive Member

Production Example

Electrophotographic Photosensitive Member 1

An aluminum cylinder (JIS-A3003, aluminum alloy) having a length of 257 mm and a diameter of 24 mm produced by a method including an extrusion step and a drawing step was used as a support (conductive support).

The support was immersed in conductive layer coating fluid 1 in an ordinary temperature and ordinary humidity (23° C./50% RH) environment to form a coating film on the support, and the coating film was dried and heat-cured at 150° C. for 20 minutes. Thus, a conductive layer having a thickness of 30 μm was formed.

The conductive layer had a volume resistivity of $1.8\times10^{12}$ Ω·cm measured by the above-described method.

An undercoat layer coating fluid was prepared by dissolving 4.5 parts of N-methoxymethylated nylon (trade name: Trezin EF-30T, manufactured by Nagase ChemteX Corporation) and 1.5 parts of a copolymer nylon resin (trade name: Amilan CM8000, manufactured by Toray Industries, Inc.) in a solvent mixture of 65 parts of methanol and 30 parts of n-butanol. The support provided with the conductive layer was immersed in the undercoat layer coating fluid to form a coating film on the conductive layer, and the coating film was dried at 70° C. for 6 minutes. Thus, an undercoat layer having a thickness of 0.85 μm was formed.

Hydroxygallium phthalocyanine (charge generation material) in a crystal form exhibiting peaks at Bragg angles) (2θ±0.2° of 7.5°, 9.9°, 16.3°, 18.6°, 25.1°, and 28.3° in the CuKα characteristic X-ray diffraction was prepared. A sand mill was charged with 10 parts of the hydroxygallium phthalocyanine crystal, 5 parts of polyvinyl butyral (trade name: Eslex BX-1, manufactured by Sekisui Chemical Co., Ltd.), and 250 parts of cyclohexanone. The mixture was subjected to dispersion treatment using glass beads having a diameter of 0.8 mm for 3 hours. To the resulting dispersion was added 250 parts of ethyl acetate to prepare a charge generating layer coating fluid. The support provided with the undercoat layer was immersed in the charge generating layer coating fluid to form a coating film on the undercoat layer, and the coating film was dried at 100° C. for 10 minutes. Thus, a charge generating layer having a thickness of 0.15 μm was formed.

A charge transporting layer coating fluid was prepared by dissolving the following components in a solvent mixture of 60 parts of o-xylene, 40 parts of dimethoxymethane, and 2.7 parts of methyl benzoate. The components were 6.0 parts of an amine compound (charge transport material) represented by Formula (CT-1):

(CT-1)

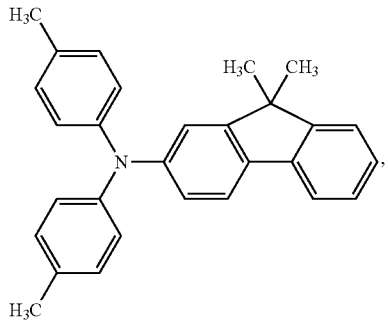

2.0 parts of an amine compound (charge transport material) represented by Formula (CT-2):

(CT-2)

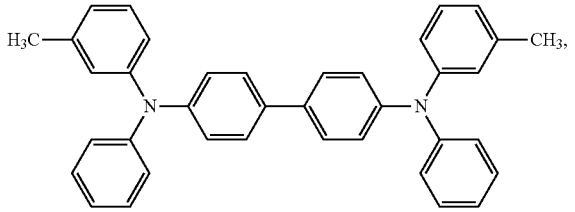

10 parts of bisphenol-Z polycarbonate (trade name: 2400, manufactured by Mitsubishi Engineering-Plastics Corporation), and 0.36 parts of siloxane-modified polycarbonate including a structural unit represented by Formula (B-1), a structural unit represented by Formula (B-2), and a terminal structure represented by Formula (B-3):

(B-1)

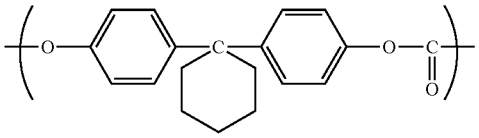

(B-2)

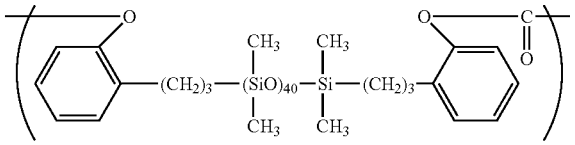

(B-3)

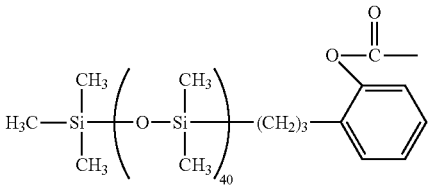

at a molar ratio of (B−1):(B-2):(B-3)=67:11:22. The support provided with the charge generating layer was immersed in this charge transporting layer coating fluid to form a coating film on the charge generating layer, and the coating film was dried at 125° C. for 30 minutes. Thus, a charge transporting layer having a thickness of 10.0 μm was formed to complete the production of electrophotographic photosensitive member 1 having the charge transporting layer as the surface layer.

Production Examples

Electrophotographic Photosensitive Members 2 to 115 and C1 to C83

Electrophotographic photosensitive members 2 to 115 and C1 to C83 each having a charge transporting layer as the surface layer were produced as in the production example of electrophotographic photosensitive member 1 except that conductive layer coating fluids 2 to 115 and C1 to C83 were used instead of conductive layer coating fluid 1 used in the production of electrophotographic photosensitive member 1. The volume resistivity of each conductive layer was measured as in electrophotographic photosensitive member 1. The results are shown in Tables 6 to 9.

Electrophotographic photosensitive members 1 to 115 and C1 to C83 were each produced two, one for conductive layer analysis and the other for a repeating paper-feeding test.

Production Examples

Electrophotographic Photosensitive Members 116 to 230 and C84 to C166

Electrophotographic photosensitive members 116 to 230 and C84 to C166, for a needle breakdown voltage test, each having a charge transporting layer as the surface layer were respectively produced as in the production examples of electrophotographic photosensitive member 1 to 115 and C1 to C83 except that the charge transporting layer had a thickness of 5.0 μm.

Examples 1 to 115 and Comparative Examples 1 to 83

Analysis of Conductive Layer of Electrophotographic Photosensitive Member

Five pieces of 5 mm square were cut from each of electrophotographic photosensitive members 1 to 115 and C1 to C83 for conductive layer analysis. The charge transporting layer, the charge generating layer, and the undercoat layer of each piece were removed by dissolving the layers in chlorobenzene, methyl ethyl ketone, and methanol to expose the conductive layer. Thus, five sample pieces were prepared for each electrophotographic photosensitive member.

The conductive layer of one of the five sample pieces of each electrophotographic photosensitive member was reduced in thickness to 150 nm with a focused ion beam (FIB) system (trade name: FB-2000A, manufactured by Hitachi High-Tech Manufacturing & Service Corporation) for processing and observing by an FIB micro-sampling method. Composition analysis of the conductive layer was performed with a high-resolution transmission electron microscope (HRTEM) (trade name: JEM-2100F, manufactured by JEOL Ltd.) and an energy dispersive X-ray spectrometer (EDX) (trade name: JED-2300T, manufactured by JEOL Ltd.). The measurement conditions of the EDX were an accelerating voltage of 200 kV and a beam diameter of 1.0 nm.

The results demonstrated that titanium oxide particles covered with aluminum-doped zinc oxide were contained in the conductive layers of electrophotographic photosensitive members 1 to 18, 115, C1 to C9, and C73; zinc oxide particles covered with aluminum-doped zinc oxide were contained in the conductive layers of electrophotographic photosensitive members 19 to 36, C19 to C27, and C74; tin oxide particles covered with aluminum-doped zinc oxide were contained in the conductive layers of electrophotographic photosensitive members 37 to 54, C37 to C45, and C75; and barium sulfate particles covered with aluminum-doped zinc oxide were contained in the conductive layers of electrophotographic photosensitive members 91 to 102 and C55 to C63.

The results also demonstrated that titanium oxide particles covered with zinc oxide were contained in the conductive layers of electrophotographic photosensitive members 55 to 66, C10 to C18, and C80 to C83; zinc oxide particles covered with zinc oxide were contained in the conductive layers of electrophotographic photosensitive members 67 to 78 and C28 to C36; tin oxide particles covered with zinc oxide were contained in the conductive layers of electrophotographic photosensitive members 79 to 90 and C46 to C54; and barium sulfate particles covered with zinc oxide were contained in the conductive layers of electrophotographic photosensitive members 103 to 114 and C64 to C72.

The results also demonstrated that aluminum-doped zinc oxide particles were contained in the conductive layers of electrophotographic photosensitive members 115, C76, and C77. The results also demonstrated that titanium oxide particles were contained in the conductive layers of electrophotographic photosensitive members 1 to 18, 55 to 66, 115, C1, C2, C4 to C11, C13 to C18, C74, and C79; zinc oxide particles were contained in the conductive layers of electrophotographic photosensitive members 19 to 36, 67 to 78, C19, C20, C22 to C29, C31 to C36, C75, C78, and C79; tin oxide particles were contained in the conductive layers of electrophotographic photosensitive members 37 to 54, 79 to 90, C37, C38, C40 to C47, C49 to C54, C73, and C78; and barium sulfate particles were contained in the conductive layers of electrophotographic photosensitive members 91 to 114, C55, C56, C58 to C65, and C67 to C72.

The conductive layers of remaining four sample pieces of each electrophotographic photosensitive member were observed in the region of 2 μm in length, 2 μm in width, and 2 μm in thickness with slice-and-view in FIB-SEM, and rendering was performed. A difference in contrast of slice-and-view in FIB-SEM can specify, for example, titanium oxide particles covered with aluminum-doped zinc oxide and titanium oxide particles. Furthermore, the volume of titanium oxide particles covered with aluminum-doped zinc oxide, the volume of titanium oxide particles, and the ratios of these particles in the conductive layer can be determined. Similarly, the volume of zinc oxide particles covered with aluminum-doped zinc oxide, the volume of zinc oxide particles, and the ratios of these particles in the conductive layer can be determined; the volume of tin oxide particles covered with aluminum-doped zinc oxide, the volume of tin oxide particles, and the ratios of these particles in the conductive layer can be determined; the volume of barium sulfate particles covered with aluminum-doped zinc oxide, the volume of barium sulfate particle, and the ratios of these particles in the conductive layer can be determined; the volume of titanium oxide particles covered with oxygen-deficient zinc oxide, the volume of titanium oxide particles, and the ratios of these particles in the conductive layer can be determined; the volume of zinc oxide particles covered with oxygen-deficient zinc oxide, the volume of zinc oxide particles, and the ratios of these particles in the conductive layer can be determined; the volume tin oxide particles covered with oxygen-deficient zinc oxide, the volume of tin oxide particles, and the ratios of these particles in the conductive layer can be determined; the volume of barium sulfate particles covered with oxygen-deficient zinc oxide, the volume of barium sulfate particles, and the ratios of these particles in the conductive layer can be determined; and the volume of aluminum-doped zinc oxide particles can be determined.

The conditions of slice-and-view in the present invention were as follows:

Sample processing for analysis: FIB method

Processing and observation apparatus: NVision 40 manufactured by SII/Zeiss

Slice interval: 10 nm

Observation conditions:

Accelerating voltage: 1.0 kV

Sample tilting: 54°

WD: 5 mm

Detector: BSE detector

Aperture: 60 μm, high current

ABC: ON

Image resolution: 1.25 nm/pixel

The analytical region was 2 μm in length and 2 μm in width. The information on the respective cross-sections were added up, and each particle volume per unit volume (8 $\mu m^3$: 2 μm in length×2 μm in with×2 μm in thickness) was determined. The measurement environment was a temperature of 23° C. and a pressure of $1\times10^{-4}$ Pa.

The processing and observation apparatus may be Strata 400S (sample tilting: 52°) manufactured by FEI Company.

The information on each cross section was obtained through image analysis of specified, for example, the area of titanium oxide particles covered with aluminum-doped zinc oxide and the area of titanium oxide particles not covered with the zinc oxide. The image analysis was performed using image processing software: Image-Pro Plus manufactured by Media Cybernetics, Inc.

From the information, the volume (V1 ($\mu m^3$)) of the first particles and the volume (V2 ($\mu m^3$)) of the second particles in unit volume (8 $\mu m^3$: 2 μm×2 μm×2 μm) were determined for each of the four sample pieces of each electrophotographic photosensitive member. The values of (V1 ($\mu m^3$)/8 ($\mu m^3$))×100, (V2 ($\mu m^3$)/8 ($\mu m^3$))×100, and (V2 ($\mu m^3$)/V1 ($\mu m^3$))×100 were further calculated. The average value of the (V1 ($\mu m^3$)/8 ($\mu m^3$))×100 values of four sample pieces was defined as the content (% by volume) of the first particles in the conductive layer based on the total volume of the conductive layer. The average value of the (V2 ($\mu m^3$)/8 ($\mu m^3$))×100 values of the four sample pieces was defined as the content (% by volume) of the second particles in the conductive layer based on the total volume of the conductive layer. The average value of the values of (V2 ($\mu m^3$)/V1 ($\mu m^3$))×100 of the four sample pieces was defined as the content (% by volume) of the second particles based on that of the first particles in the conductive layer.

The average primary particle diameter of the first particles and the average primary particle diameter of the second particles were determined for each of the four sample pieces. The average primary particle diameter (μm) is the arithmetic mean of the measured diameters of individual first or second particles in an analytical region of 2 μm in length and 2 μm in width. Each particle diameter was calculated as the value of (a+b)/2 of the longest side "a" and the shortest side "b" of a primary particle. The information on the respective cross-sections were added up, and each average primary particle diameter per unit volume (8 $\mu m^3$: 2 μm in length×2 μm in with×2 μm in thickness) was determined.

The average value of the average primary particle diameters of the first particles in the four sample pieces was defined as the average primary particle diameter (D1) of the first particles in the conductive layer. The average value of the average primary particle diameters of the second particles in the four sample pieces was defined as the average primary particle diameter (D2) of the second particles in the conductive layer.

The results are shown in Tables 6 to 9.

TABLE 6

| Example | Conductive layer coating fluid | Electro-photographic photosensitive member | Content of first particle (% by vol.) | Content of second particle (% by vol.) | Content of second particle relative to that of first particle (% by vol.) | $D_1$ (μm) | $D_2$ (μm) | $D_1/D_2$ | Volume resistivity of conductive layer (Ω · cm) |
|---|---|---|---|---|---|---|---|---|---|
| 1 | 1 | 1 | 22 | 2.2 | 10.0 | 0.20 | 0.20 | 1.0 | $1.8 \times 10^{12}$ |
| 2 | 2 | 2 | 21 | 5.8 | 27.6 | 0.20 | 0.20 | 1.0 | $2.0 \times 10^{12}$ |
| 3 | 3 | 3 | 21 | 6.0 | 28.6 | 0.20 | 0.20 | 1.0 | $2.0 \times 10^{12}$ |
| 4 | 4 | 4 | 21 | 0.1 | 0.50 | 0.20 | 0.20 | 1.0 | $2.0 \times 10^{12}$ |
| 5 | 5 | 5 | 40 | 3.7 | 9.3 | 0.20 | 0.20 | 1.0 | $6.3 \times 10^{10}$ |
| 6 | 6 | 6 | 48 | 6.6 | 13.8 | 0.20 | 0.20 | 1.0 | $5.5 \times 10^{8}$ |
| 7 | 7 | 7 | 50 | 3.5 | 7.0 | 0.20 | 0.20 | 1.0 | $4.5 \times 10^{8}$ |
| 8 | 8 | 8 | 39 | 5.9 | 15.1 | 0.20 | 0.20 | 1.0 | $6.5 \times 10^{10}$ |
| 9 | 9 | 9 | 37 | 10.2 | 27.6 | 0.20 | 0.20 | 1.0 | $7.0 \times 10^{10}$ |
| 10 | 10 | 10 | 45 | 12.3 | 27.3 | 0.20 | 0.20 | 1.0 | $2.0 \times 10^{9}$ |
| 11 | 11 | 11 | 49 | 14.6 | 29.8 | 0.20 | 0.20 | 1.0 | $5.0 \times 10^{8}$ |
| 12 | 12 | 12 | 41 | 2.3 | 5.6 | 0.45 | 0.20 | 2.3 | $6.0 \times 10^{10}$ |
| 13 | 13 | 13 | 41 | 2.3 | 5.6 | 0.45 | 0.40 | 1.1 | $6.0 \times 10^{10}$ |
| 14 | 14 | 14 | 41 | 2.3 | 5.6 | 0.15 | 0.15 | 1.0 | $6.0 \times 10^{10}$ |
| 15 | 15 | 15 | 41 | 2.3 | 5.6 | 0.15 | 0.10 | 1.5 | $6.0 \times 10^{10}$ |
| 16 | 16 | 16 | 40 | 3.7 | 9.3 | 0.20 | 0.20 | 1.0 | $6.3 \times 10^{9}$ |
| 17 | 17 | 17 | 40 | 3.7 | 9.3 | 0.20 | 0.20 | 1.0 | $6.3 \times 10^{11}$ |
| 18 | 18 | 18 | 28 | 2.4 | 8.6 | 0.20 | 0.18 | 1.1 | $1.2 \times 10^{12}$ |
| 19 | 19 | 19 | 21 | 1.9 | 9.0 | 0.20 | 0.20 | 1.0 | $2.0 \times 10^{12}$ |
| 20 | 20 | 20 | 21 | 4.6 | 21.9 | 0.20 | 0.20 | 1.0 | $2.0 \times 10^{12}$ |
| 21 | 21 | 21 | 21 | 4.7 | 22.4 | 0.20 | 0.20 | 1.0 | $2.0 \times 10^{12}$ |
| 22 | 22 | 22 | 20 | 0.1 | 0.5 | 0.20 | 0.20 | 1.0 | $5.0 \times 10^{12}$ |
| 23 | 23 | 23 | 37 | 3.0 | 8.1 | 0.20 | 0.20 | 1.0 | $7.0 \times 10^{10}$ |
| 24 | 24 | 24 | 45 | 5.3 | 11.8 | 0.20 | 0.20 | 1.0 | $2.0 \times 10^{9}$ |
| 25 | 25 | 25 | 46 | 2.9 | 6.3 | 0.20 | 0.20 | 1.0 | $1.0 \times 10^{9}$ |
| 26 | 26 | 26 | 37 | 4.7 | 12.7 | 0.20 | 0.20 | 1.0 | $7.0 \times 10^{10}$ |
| 27 | 27 | 27 | 35 | 8.1 | 23.1 | 0.20 | 0.20 | 1.0 | $1.0 \times 10^{11}$ |
| 28 | 28 | 28 | 43 | 9.9 | 23.0 | 0.20 | 0.20 | 1.0 | $3.0 \times 10^{10}$ |
| 29 | 29 | 29 | 49 | 14.6 | 29.8 | 0.20 | 0.20 | 1.0 | $5.0 \times 10^{8}$ |
| 30 | 30 | 30 | 38 | 2.0 | 5.3 | 0.45 | 0.20 | 2.3 | $6.7 \times 10^{10}$ |
| 31 | 31 | 31 | 38 | 2.0 | 5.3 | 0.45 | 0.40 | 1.1 | $6.7 \times 10^{10}$ |
| 32 | 32 | 32 | 38 | 2.1 | 5.5 | 0.15 | 0.15 | 1.0 | $6.7 \times 10^{10}$ |
| 33 | 33 | 33 | 38 | 2.1 | 5.5 | 0.15 | 0.10 | 1.5 | $6.7 \times 10^{10}$ |
| 34 | 34 | 34 | 37 | 3.0 | 8.1 | 0.20 | 0.20 | 1.0 | $7.0 \times 10^{9}$ |
| 35 | 35 | 35 | 37 | 3.0 | 8.1 | 0.20 | 0.20 | 1.0 | $7.0 \times 10^{11}$ |
| 36 | 36 | 36 | 26 | 2.0 | 7.7 | 0.20 | 0.18 | 1.1 | $1.6 \times 10^{12}$ |
| 37 | 37 | 37 | 22 | 1.8 | 8.2 | 0.20 | 0.20 | 1.0 | $1.8 \times 10^{12}$ |
| 38 | 38 | 38 | 22 | 4.1 | 20.5 | 0.20 | 0.20 | 1.0 | $1.8 \times 10^{12}$ |
| 39 | 39 | 39 | 22 | 4.2 | 20.5 | 0.20 | 0.20 | 1.0 | $1.8 \times 10^{12}$ |
| 40 | 40 | 40 | 20 | 0.1 | 0.5 | 0.20 | 0.20 | 1.0 | $5.0 \times 10^{12}$ |
| 41 | 41 | 41 | 37 | 2.8 | 7.6 | 0.20 | 0.20 | 1.0 | $7.0 \times 10^{10}$ |
| 42 | 42 | 42 | 44 | 4.8 | 10.9 | 0.20 | 0.20 | 1.0 | $8.0 \times 10^{9}$ |
| 43 | 43 | 43 | 45 | 2.7 | 6.0 | 0.20 | 0.20 | 1.0 | $2.0 \times 10^{9}$ |
| 44 | 44 | 44 | 36 | 4.3 | 11.9 | 0.20 | 0.20 | 1.0 | $8.5 \times 10^{10}$ |
| 45 | 45 | 45 | 35 | 7.3 | 20.9 | 0.20 | 0.20 | 1.0 | $1.0 \times 10^{11}$ |
| 46 | 46 | 46 | 42 | 9.2 | 21.9 | 0.20 | 0.20 | 1.0 | $4.5 \times 10^{10}$ |
| 47 | 47 | 47 | 50 | 14.0 | 28.0 | 0.20 | 0.20 | 1.0 | $4.5 \times 10^{8}$ |
| 48 | 48 | 48 | 37 | 1.9 | 5.1 | 0.45 | 0.20 | 2.3 | $7.0 \times 10^{10}$ |
| 49 | 49 | 49 | 37 | 1.9 | 5.1 | 0.45 | 0.40 | 1.1 | $7.0 \times 10^{10}$ |
| 50 | 50 | 50 | 37 | 2.0 | 5.4 | 0.15 | 0.15 | 1.0 | $7.0 \times 10^{10}$ |
| 51 | 51 | 51 | 37 | 2.0 | 5.4 | 0.15 | 0.10 | 1.5 | $7.0 \times 10^{10}$ |
| 52 | 52 | 52 | 37 | 2.8 | 7.6 | 0.20 | 0.20 | 1.0 | $7.0 \times 10^{9}$ |
| 53 | 53 | 53 | 37 | 2.8 | 7.6 | 0.20 | 0.20 | 1.0 | $7.0 \times 10^{11}$ |
| 54 | 54 | 54 | 26 | 2.0 | 7.7 | 0.20 | 0.18 | 1.1 | $1.6 \times 10^{12}$ |

TABLE 7

| Example | Conductive layer coating fluid | Electro-photographic photosensitive member | Content of first particle (% by vol.) | Content of second particle (% by vol.) | Content of second particle relative to that of first particle (% by vol.) | $D_1$ (μm) | $D_2$ (μm) | $D_1/D_2$ | Volume resistivity of conductive layer (Ω · cm) |
|---|---|---|---|---|---|---|---|---|---|
| 55 | 55 | 55 | 20 | 0.1 | 0.5 | 0.20 | 0.20 | 1.0 | $2.0 \times 10^{12}$ |
| 56 | 56 | 56 | 42 | 2.2 | 5.2 | 0.20 | 0.20 | 1.0 | $4.5 \times 10^{10}$ |
| 57 | 57 | 57 | 41 | 3.6 | 8.8 | 0.20 | 0.20 | 1.0 | $6.0 \times 10^{10}$ |
| 58 | 58 | 58 | 50 | 6.2 | 12.4 | 0.20 | 0.20 | 1.0 | $4.5 \times 10^{8}$ |
| 59 | 59 | 59 | 40 | 5.8 | 14.5 | 0.20 | 0.20 | 1.0 | $6.3 \times 10^{10}$ |

TABLE 7-continued

| Example | Conductive layer coating fluid | Electro-photographic photosensitive member | Content of first particle (% by vol.) | Content of second particle (% by vol.) | Content of second particle relative to that of first particle (% by vol.) | $D_1$ (μm) | $D_2$ (μm) | $D_1/D_2$ | Volume resistivity of conductive layer (Ω · cm) |
|---|---|---|---|---|---|---|---|---|---|
| 60 | 60 | 60 | 38 | 10 | 26.3 | 0.20 | 0.20 | 1.0 | $6.7 \times 10^{10}$ |
| 61 | 61 | 61 | 50 | 11.1 | 22.2 | 0.20 | 0.20 | 1.0 | $4.5 \times 10^{8}$ |
| 62 | 62 | 62 | 50 | 14.7 | 29.4 | 0.20 | 0.20 | 1.0 | $4.5 \times 10^{8}$ |
| 63 | 63 | 63 | 41 | 3.6 | 8.8 | 0.45 | 0.20 | 2.3 | $6.0 \times 10^{10}$ |
| 64 | 64 | 64 | 41 | 3.6 | 8.8 | 0.45 | 0.40 | 1.1 | $6.0 \times 10^{10}$ |
| 65 | 65 | 65 | 41 | 3.6 | 8.8 | 0.15 | 0.15 | 1.0 | $6.0 \times 10^{10}$ |
| 66 | 66 | 66 | 41 | 3.6 | 8.8 | 0.15 | 0.10 | 1.5 | $6.0 \times 10^{10}$ |
| 67 | 67 | 67 | 20 | 0.1 | 0.5 | 0.20 | 0.20 | 1.0 | $2.0 \times 10^{12}$ |
| 68 | 68 | 68 | 39 | 1.8 | 4.6 | 0.20 | 0.20 | 1.0 | $6.5 \times 10^{10}$ |
| 69 | 69 | 69 | 38 | 2.9 | 7.6 | 0.20 | 0.20 | 1.0 | $6.7 \times 10^{10}$ |
| 70 | 70 | 70 | 50 | 5.1 | 10.2 | 0.20 | 0.20 | 1.0 | $4.5 \times 10^{8}$ |
| 71 | 71 | 71 | 38 | 4.7 | 12.4 | 0.20 | 0.20 | 1.0 | $6.7 \times 10^{10}$ |
| 72 | 72 | 72 | 36 | 7.9 | 21.9 | 0.20 | 0.20 | 1.0 | $8.5 \times 10^{10}$ |
| 73 | 73 | 73 | 48 | 10.2 | 21.3 | 0.20 | 0.20 | 1.0 | $5.5 \times 10^{8}$ |
| 74 | 74 | 74 | 47 | 14.1 | 30.0 | 0.20 | 0.20 | 1.0 | $8.0 \times 10^{8}$ |
| 75 | 75 | 75 | 38 | 3.0 | 7.9 | 0.45 | 0.20 | 2.3 | $6.7 \times 10^{10}$ |
| 76 | 76 | 76 | 38 | 3.0 | 7.9 | 0.45 | 0.40 | 1.1 | $6.7 \times 10^{10}$ |
| 77 | 77 | 77 | 38 | 3.0 | 7.9 | 0.15 | 0.15 | 1.0 | $6.7 \times 10^{10}$ |
| 78 | 78 | 78 | 38 | 3.0 | 7.9 | 0.15 | 0.10 | 1.5 | $6.7 \times 10^{10}$ |
| 79 | 79 | 79 | 21 | 0.1 | 0.5 | 0.20 | 0.20 | 1.0 | $2.0 \times 10^{12}$ |
| 80 | 80 | 80 | 38 | 1.8 | 4.7 | 0.20 | 0.20 | 1.0 | $6.7 \times 10^{10}$ |
| 81 | 81 | 81 | 37 | 2.7 | 7.3 | 0.20 | 0.20 | 1.0 | $7.0 \times 10^{10}$ |
| 82 | 82 | 82 | 50 | 2.2 | 4.4 | 0.20 | 0.20 | 1.0 | $4.5 \times 10^{8}$ |
| 83 | 83 | 83 | 37 | 4.3 | 11.6 | 0.20 | 0.20 | 1.0 | $7.0 \times 10^{10}$ |
| 84 | 84 | 84 | 36 | 7.4 | 20.6 | 0.20 | 0.20 | 1.0 | $8.5 \times 10^{10}$ |
| 85 | 85 | 85 | 47 | 9.4 | 21.1 | 0.20 | 0.20 | 1.0 | $8.0 \times 10^{8}$ |
| 86 | 86 | 86 | 48 | 14.2 | 29.6 | 0.20 | 0.20 | 1.0 | $5.5 \times 10^{8}$ |
| 87 | 87 | 87 | 37 | 2.8 | 7.6 | 0.45 | 0.20 | 2.3 | $7.0 \times 10^{10}$ |
| 88 | 88 | 88 | 37 | 2.8 | 7.6 | 0.45 | 0.40 | 1.1 | $7.0 \times 10^{10}$ |
| 89 | 89 | 89 | 37 | 2.8 | 7.6 | 0.15 | 0.15 | 1.0 | $7.0 \times 10^{10}$ |
| 90 | 90 | 90 | 37 | 2.8 | 7.6 | 0.15 | 0.10 | 1.5 | $7.0 \times 10^{10}$ |
| 91 | 91 | 91 | 21 | 0.1 | 0.5 | 0.20 | 0.20 | 1.0 | $2.0 \times 10^{12}$ |
| 92 | 92 | 92 | 40 | 2.2 | 5.5 | 0.20 | 0.20 | 1.0 | $6.3 \times 10^{10}$ |
| 93 | 93 | 93 | 40 | 3.4 | 8.5 | 0.20 | 0.20 | 1.0 | $6.3 \times 10^{10}$ |
| 94 | 94 | 94 | 50 | 2.9 | 5.8 | 0.20 | 0.20 | 1.0 | $4.5 \times 10^{8}$ |
| 95 | 95 | 95 | 39 | 5.3 | 13.6 | 0.20 | 0.20 | 1.0 | $6.5 \times 10^{10}$ |
| 96 | 96 | 96 | 37 | 9.4 | 25.4 | 0.20 | 0.20 | 1.0 | $7.0 \times 10^{10}$ |
| 97 | 97 | 97 | 49 | 11.4 | 23.3 | 0.20 | 0.20 | 1.0 | $5.0 \times 10^{8}$ |
| 98 | 98 | 98 | 50 | 14.7 | 29.4 | 0.20 | 0.20 | 1.0 | $4.5 \times 10^{8}$ |
| 99 | 99 | 99 | 40 | 3.6 | 9.0 | 0.45 | 0.20 | 2.3 | $6.3 \times 10^{10}$ |
| 100 | 100 | 100 | 40 | 3.6 | 9.0 | 0.45 | 0.40 | 1.1 | $6.3 \times 10^{10}$ |
| 101 | 101 | 101 | 40 | 3.6 | 9.0 | 0.15 | 0.15 | 1.0 | $6.3 \times 10^{10}$ |
| 102 | 102 | 102 | 40 | 3.6 | 9.0 | 0.15 | 0.10 | 1.5 | $6.3 \times 10^{10}$ |

TABLE 8

| Example/Comparative Example | Conductive layer coating fluid | Electro-photographic photosensitive member | Content of first particle (% by vol.) | Content of second particle (% by vol.) | Content of second particle relative to that of first particle (% by vol.) | $D_1$ (μm) | $D_2$ (μm) | $D_1/D_2$ | Volume resistivity of conductive layer (Ω · cm) |
|---|---|---|---|---|---|---|---|---|---|
| 103 | 103 | 103 | 21 | 0.1 | 0.5 | 0.20 | 0.20 | 1.0 | $2.0 \times 10^{12}$ |
| 104 | 104 | 104 | 40 | 2.2 | 5.5 | 0.20 | 0.20 | 1.0 | $6.3 \times 10^{10}$ |
| 105 | 105 | 105 | 40 | 3.4 | 8.5 | 0.20 | 0.20 | 1.0 | $6.3 \times 10^{10}$ |
| 106 | 106 | 106 | 50 | 2.9 | 5.8 | 0.20 | 0.20 | 1.0 | $4.5 \times 10^{8}$ |
| 107 | 107 | 107 | 39 | 5.3 | 13.6 | 0.20 | 0.20 | 1.0 | $6.5 \times 10^{10}$ |
| 108 | 108 | 108 | 37 | 9.4 | 25.4 | 0.20 | 0.20 | 1.0 | $7.0 \times 10^{10}$ |
| 109 | 109 | 109 | 49 | 11.4 | 23.3 | 0.20 | 0.20 | 1.0 | $4.5 \times 10^{8}$ |
| 110 | 110 | 110 | 50 | 14.7 | 29.4 | 0.20 | 0.20 | 1.0 | $5.0 \times 10^{8}$ |
| 111 | 111 | 111 | 40 | 3.6 | 9.0 | 0.45 | 0.20 | 2.3 | $6.3 \times 10^{10}$ |
| 112 | 112 | 112 | 40 | 3.6 | 9.0 | 0.45 | 0.40 | 1.1 | $6.3 \times 10^{10}$ |
| 113 | 113 | 113 | 40 | 3.6 | 9.0 | 0.15 | 0.15 | 1.0 | $6.3 \times 10^{10}$ |
| 114 | 114 | 114 | 40 | 3.6 | 9.0 | 0.15 | 0.10 | 1.5 | $6.3 \times 10^{10}$ |
| 115 | 115 | 115 | 38 | 5.7 | 15.0 | 0.20 | 0.20 | 1.0 | $6.5 \times 10^{9}$ |
| Comparative Example 1 | C1 | C1 | 19 | 1.8 | 9.5 | 0.20 | 0.20 | 1.0 | $1.0 \times 10^{13}$ |
| Comparative Example 2 | C2 | C2 | 51 | 6.1 | 12.0 | 0.20 | 0.20 | 1.0 | $3.0 \times 10^{8}$ |
| Comparative Example 3 | C3 | C3 | 38 | — | — | 0.20 | — | — | $6.7 \times 10^{10}$ |
| Comparative Example 4 | C4 | C4 | 38 | 0.04 | 0.1 | 0.20 | 0.20 | 1.0 | $6.7 \times 10^{10}$ |

TABLE 8-continued

| Example/Comparative Example | Conductive layer coating fluid | Electro-photographic photosensitive member | Content of first particle (% by vol.) | Content of second particle (% by vol.) | Content of second particle relative to that of first particle (% by vol.) | $D_1$ (μm) | $D_2$ (μm) | $D_1/D_2$ | Volume resistivity of conductive layer (Ω · cm) |
|---|---|---|---|---|---|---|---|---|---|
| Comparative Example 5 | C5 | C5 | 51 | 0.04 | 0.1 | 0.20 | 0.20 | 1.0 | $3.0 \times 10^{8}$ |
| Comparative Example 6 | C6 | C6 | 32 | 16.2 | 50.6 | 0.20 | 0.20 | 1.0 | $8.0 \times 10^{11}$ |
| Comparative Example 7 | C7 | C7 | 47 | 15.9 | 33.8 | 0.20 | 0.20 | 1.0 | $8.0 \times 10^{8}$ |
| Comparative Example 8 | C8 | C8 | 38 | 0.14 | 0.4 | 0.20 | 0.20 | 1.0 | $6.7 \times 10^{10}$ |
| Comparative Example 9 | C9 | C9 | 34 | 10.7 | 31.5 | 0.20 | 0.20 | 1.0 | $5.0 \times 10^{11}$ |
| Comparative Example 10 | C10 | C10 | 19 | 1.8 | 9.5 | 0.20 | 0.20 | 1.0 | $1.0 \times 10^{13}$ |
| Comparative Example 11 | C11 | C11 | 51 | 6.1 | 12.0 | 0.20 | 0.20 | 1.0 | $3.0 \times 10^{8}$ |
| Comparative Example 12 | C12 | C12 | 38 | — | — | 0.20 | — | — | $6.7 \times 10^{10}$ |
| Comparative Example 13 | C13 | C13 | 38 | 0.04 | 0.1 | 0.20 | 0.20 | 1.0 | $6.7 \times 10^{10}$ |
| Comparative Example 14 | C14 | C14 | 51 | 0.04 | 0.1 | 0.20 | 0.20 | 1.0 | $3.0 \times 10^{8}$ |
| Comparative Example 15 | C15 | C15 | 32 | 16.2 | 50.6 | 0.20 | 0.20 | 1.0 | $8.0 \times 10^{11}$ |
| Comparative Example 16 | C16 | C16 | 47 | 15.9 | 33.8 | 0.20 | 0.20 | 1.0 | $8.0 \times 10^{8}$ |
| Comparative Example 17 | C17 | C17 | 38 | 0.14 | 0.4 | 0.20 | 0.20 | 1.0 | $6.7 \times 10^{10}$ |
| Comparative Example 18 | C18 | C18 | 34 | 10.7 | 31.5 | 0.20 | 0.20 | 1.0 | $5.0 \times 10^{11}$ |
| Comparative Example 19 | C19 | C19 | 19 | 1.3 | 6.8 | 0.20 | 0.20 | 1.0 | $1.0 \times 10^{13}$ |
| Comparative Example 20 | C20 | C20 | 51 | 4.5 | 8.8 | 0.20 | 0.20 | 1.0 | $3.0 \times 10^{8}$ |
| Comparative Example 21 | C21 | C21 | 36 | — | — | 0.20 | — | - | $8.5 \times 10^{10}$ |
| Comparative Example 22 | C22 | C22 | 36 | 0.04 | 0.1 | 0.20 | 0.20 | 1.0 | $8.5 \times 10^{10}$ |
| Comparative Example 23 | C23 | C23 | 48 | 0.04 | 0.1 | 0.20 | 0.20 | 1.0 | $5.5 \times 10^{8}$ |
| Comparative Example 24 | C24 | C24 | 30 | 17.1 | 57 | 0.20 | 0.20 | 1.0 | $9.0 \times 10^{11}$ |
| Comparative Example 25 | C25 | C25 | 44 | 16.2 | 36.8 | 0.20 | 0.20 | 1.0 | $8.0 \times 10^{9}$ |
| Comparative Example 26 | C26 | C26 | 36 | 0.1 | 0.3 | 0.20 | 0.20 | 1.0 | $8.5 \times 10^{10}$ |
| Comparative Example 27 | C27 | C27 | 33 | 10.7 | 32.4 | 0.20 | 0.20 | 1.0 | $6.5 \times 10^{11}$ |
| Comparative Example 28 | C28 | C28 | 19 | 1.3 | 6.8 | 0.20 | 0.20 | 1.0 | $1.0 \times 10^{13}$ |
| Comparative Example 29 | C29 | C29 | 51 | 4.5 | 8.8 | 0.20 | 0.20 | 1.0 | $3.0 \times 10^{8}$ |
| Comparative Example 30 | C30 | C30 | 36 | — | — | 0.20 | — | — | $8.5 \times 10^{10}$ |
| Comparative Example 31 | C31 | C31 | 36 | 0.04 | 0.1 | 0.20 | 0.20 | 1.0 | $8.5 \times 10^{10}$ |
| Comparative Example 32 | C32 | C32 | 48 | 0.04 | 0.1 | 0.20 | 0.20 | 1.0 | $5.5 \times 10^{8}$ |
| Comparative Example 33 | C33 | C33 | 30 | 17.1 | 57 | 0.20 | 0.20 | 1.0 | $9.0 \times 10^{11}$ |
| Comparative Example 34 | C34 | C34 | 44 | 16.2 | 36.8 | 0.20 | 0.20 | 1.0 | $8.0 \times 10^{9}$ |
| Comparative Example 35 | C35 | C35 | 36 | 0.1 | 0.3 | 0.20 | 0.20 | 1.0 | $8.5 \times 10^{10}$ |
| Comparative Example 36 | C36 | C36 | 33 | 10.7 | 32.4 | 0.20 | 0.20 | 1.0 | $6.5 \times 10^{11}$ |

TABLE 9

| Example/Comparative Example | Conductive layer coating fluid | Electro-photographic photosensitive member | Content of first particle (% by vol.) | Content of second particle (% by vol.) | Content of second particle relative to that of first particle (% by vol.) | $D_1$ (μm) | $D_2$ (μm) | $D_1/D_2$ | Volume resistivity of conductive layer (Ω · cm) |
|---|---|---|---|---|---|---|---|---|---|
| Comparative Example 37 | C37 | C37 | 19 | 1.1 | 5.8 | 0.20 | 0.20 | 1.0 | $1.0 \times 10^{13}$ |
| Comparative Example 38 | C38 | C38 | 51 | 3.9 | 7.6 | 0.20 | 0.20 | 1.0 | $3.0 \times 10^{8}$ |
| Comparative Example 39 | C39 | C39 | 36 | — | — | 0.20 | — | — | $8.5 \times 10^{10}$ |
| Comparative Example 40 | C40 | C40 | 36 | 0.04 | 0.1 | 0.20 | 0.20 | 1.0 | $8.5 \times 10^{10}$ |
| Comparative Example 41 | C41 | C41 | 46 | 0.04 | 0.1 | 0.20 | 0.20 | 1.0 | $1.0 \times 10^{9}$ |
| Comparative Example 42 | C42 | C42 | 30 | 16.3 | 54.3 | 0.20 | 0.20 | 1.0 | $9.0 \times 10^{11}$ |
| Comparative Example 43 | C43 | C43 | 42 | 16.2 | 38.6 | 0.20 | 0.20 | 1.0 | $4.5 \times 10^{10}$ |
| Comparative Example 44 | C44 | C44 | 35 | 0.1 | 0.3 | 0.20 | 0.20 | 1.0 | $1.0 \times 10^{11}$ |
| Comparative Example 45 | C45 | C45 | 32 | 10.0 | 31.3 | 0.20 | 0.20 | 1.0 | $8.0 \times 10^{11}$ |
| Comparative Example 46 | C46 | C46 | 19 | 1.1 | 5.8 | 0.20 | 0.20 | 1.0 | $1.0 \times 10^{13}$ |
| Comparative Example 47 | C47 | C47 | 51 | 3.9 | 7.6 | 0.20 | 0.20 | 1.0 | $3.0 \times 10^{8}$ |
| Comparative Example 48 | C48 | C48 | 36 | — | — | 0.20 | — | — | $8.5 \times 10^{10}$ |
| Comparative Example 49 | C49 | C49 | 36 | 0.04 | 0.1 | 0.20 | 0.20 | 1.0 | $8.5 \times 10^{10}$ |
| Comparative Example 50 | C50 | C50 | 46 | 0.04 | 0.1 | 0.20 | 0.20 | 1.0 | $1.0 \times 10^{9}$ |
| Comparative Example 51 | C51 | C51 | 30 | 16.3 | 54.3 | 0.20 | 0.20 | 1.0 | $9.0 \times 10^{11}$ |
| Comparative Example 52 | C52 | C52 | 42 | 16.2 | 38.6 | 0.20 | 0.20 | 1.0 | $4.5 \times 10^{10}$ |
| Comparative Example 53 | C53 | C53 | 35 | 0.1 | 0.3 | 0.20 | 0.20 | 1.0 | $1.0 \times 10^{11}$ |
| Comparative Example 54 | C54 | C54 | 32 | 10.0 | 31.3 | 0.20 | 0.20 | 1.0 | $8.0 \times 10^{11}$ |
| Comparative Example 55 | C55 | C55 | 18 | 1.6 | 8.9 | 0.20 | 0.20 | 1.0 | $5.0 \times 10^{13}$ |
| Comparative Example 56 | C56 | C56 | 51 | 5.5 | 10.8 | 0.20 | 0.20 | 1.0 | $3.0 \times 10^{8}$ |
| Comparative Example 57 | C57 | C57 | 36 | — | — | 0.20 | — | — | $8.5 \times 10^{10}$ |
| Comparative Example 58 | C58 | C58 | 36 | 0.03 | 0.1 | 0.20 | 0.20 | 1.0 | $8.5 \times 10^{10}$ |
| Comparative Example 59 | C59 | C59 | 50 | 0.03 | 0.1 | 0.20 | 0.20 | 1.0 | $4.5 \times 10^{8}$ |
| Comparative Example 60 | C60 | C60 | 30 | 16.2 | 54 | 0.20 | 0.20 | 1.0 | $9.0 \times 10^{11}$ |
| Comparative Example 61 | C61 | C61 | 45 | 17.1 | 38 | 0.20 | 0.20 | 1.0 | $2.0 \times 10^{9}$ |
| Comparative Example 62 | C62 | C62 | 36 | 0.1 | 0.3 | 0.20 | 0.20 | 1.0 | $8.5 \times 10^{10}$ |
| Comparative Example 63 | C63 | C63 | 33 | 10.5 | 31.8 | 0.20 | 0.20 | 1.0 | $6.5 \times 10^{11}$ |
| Comparative Example 64 | C64 | C64 | 18 | 1.6 | 8.9 | 0.20 | 0.20 | 1.0 | $5.0 \times 10^{13}$ |

TABLE 9-continued

| Example/Comparative Example | Conductive layer coating fluid | Electro-photographic photosensitive member | Content of first particle (% by vol.) | Content of second particle (% by vol.) | Content of second particle relative to that of first particle (% by vol.) | $D_1$ (μm) | $D_2$ (μm) | $D_1/D_2$ | Volume resistivity of conductive layer (Ω · cm) |
|---|---|---|---|---|---|---|---|---|---|
| Comparative Example 65 | C65 | C65 | 51 | 5.5 | 10.8 | 0.20 | 0.20 | 1.0 | $3.0 \times 10^8$ |
| Comparative Example 66 | C66 | C66 | 36 | — | — | 0.20 | — | — | $8.5 \times 10^{10}$ |
| Comparative Example 67 | C67 | C67 | 36 | 0.03 | 0.1 | 0.20 | 0.20 | 1.0 | $8.5 \times 10^{10}$ |
| Comparative Example 68 | C68 | C68 | 50 | 0.03 | 0.1 | 0.20 | 0.20 | 1.0 | $4.5 \times 10^8$ |
| Comparative Example 69 | C69 | C69 | 30 | 16.2 | 54 | 0.20 | 0.20 | 1.0 | $9.0 \times 10^{11}$ |
| Comparative Example 70 | C70 | C70 | 45 | 17.1 | 38 | 0.20 | 0.20 | 1.0 | $2.0 \times 10^9$ |
| Comparative Example 71 | C71 | C71 | 36 | 0.1 | 0.3 | 0.20 | 0.20 | 1.0 | $8.5 \times 10^{10}$ |
| Comparative Example 72 | C72 | C72 | 33 | 10.5 | 31.8 | 0.20 | 0.20 | 1.0 | $6.5 \times 10^{11}$ |
| Comparative Example 73 | C73 | C73 | 40 | 6.1 | 15.3 | 0.20 | 0.20 | 1.0 | $6.7 \times 10^{10}$ |
| Comparative Example 74 | C74 | C74 | 36 | 4.7 | 13.1 | 0.20 | 0.20 | 1.0 | $8.5 \times 10^{10}$ |
| Comparative Example 75 | C75 | C75 | 36 | 4.3 | 11.9 | 0.20 | 0.20 | 1.0 | $8.5 \times 10^{10}$ |
| Comparative Example 76 | C76 | C76 | 42 | — | — | 0.20 | — | — | $7.0 \times 10^8$ |
| Comparative Example 77 | C77 | C77 | 37 | 4.7 | 12.7 | 0.20 | 0.20 | 1.0 | $9.0 \times 10^8$ |
| Comparative Example 78 | C78 | C78 | 20 | 17 | 85 | 0.20 | 0.20 | 1.0 | $1.0 \times 10^{14}$ |
| Comparative Example 79 | C79 | C79 | 18 | 26 | 144 | 0.20 | 0.20 | 1.0 | $1.0 \times 10^{14}$ |
| Comparative Example 80 | C80 | C80 | 42 | — | — | 0.03 | — | — | $7.7 \times 10^{10}$ |
| Comparative Example 81 | C81 | C81 | 47 | — | — | 0.055 | — | — | $8.0 \times 10^8$ |
| Comparative Example 82 | C82 | C82 | 47 | — | — | 0.07 | — | — | $8.0 \times 10^8$ |
| Comparative Example 83 | C83 | C83 | 48 | — | — | 0.065 | — | — | $7.5 \times 10^8$ |

(Repeating Paper-Feeding Test of Electrophotographic Photosensitive Member)

Electrophotographic photosensitive members 1 to 115 and C1 to C83 for a repeating paper-feeding test were each installed on a laser beam printer (trade name: LBP7200C, manufactured by CANON KABUSHIKI KAISHA) and subjected to a repeating paper-feeding test in a low-temperature and low-humidity (15° C./10% RH) environment for image evaluation. In the printing operation of the repeating paper-feeding test, a text image with a printing ratio of 2% was output on 3000 sheets of letter-size paper in an intermittent mode.

A sample (half-tone image of a similar knight jump pattern) for image evaluation was output at each of the times of starting of the repeating paper-feeding test, after the completion of image output of 1500 sheets, and after the completion of image output of 3000 sheets. The criteria of evaluating images are as follows:

A: No image defect due to occurrence of current leakage was observed in the image, B: A small black spot due to occurrence of current leakage was observed in the image, C: A large black spot due to occurrence of current leakage was observed in the image, D: A large black spot and a short horizontal black streak due to occurrence of current leakage were observed in the image, and E: A long horizontal black streak due to occurrence of current leakage was observed in the image.

The charged potential (dark portion potential) and the exposure potential (light portion potential) were measured after the output of the samples for image evaluation at the times of starting of the repeating paper-feeding test and after the completion of image output of 3000 sheets. The measurement of potentials was performed using one white solid image and one black solid image. The variation amount in dark portion potential, ΔVd (=|Vd'|−|Vd|), which is the difference between the dark portion potential Vd' after the completion of image output of 3000 sheets and the dark portion potential Vd at the beginning (at the time of starting of the repeating paper-feeding test), was determined. The variation amount in light portion potential, ΔVl (=|Vl'|−|Vl|), which is the difference between the light portion potential Vl' after the completion of image output of 3000 sheets and the light portion potential Vl at the beginning (at the time of starting of the repeating paper-feeding test), was determined. The results are shown in Tables 10 and 11.

TABLE 10

| Example | Electro-photographic photosensitive member | Leakage: At starting of paper-feeding test | Leakage: After completion of image output on 1500 sheets | Leakage: After completion of image output on 3000 sheets | Variation amount in potential [V]: ΔVd | Variation amount in potential [V]: ΔVl |
|---|---|---|---|---|---|---|
| 1 | 1 | A | A | A | +10 | +25 |
| 2 | 2 | A | A | A | +15 | +30 |
| 3 | 3 | A | A | A | +15 | +30 |
| 4 | 4 | A | B | B | +15 | +30 |
| 5 | 5 | A | A | A | +10 | +15 |
| 6 | 6 | A | A | A | +8 | +10 |
| 7 | 7 | A | A | A | +8 | +10 |
| 8 | 8 | A | A | A | +10 | +20 |
| 9 | 9 | A | A | A | +10 | +20 |

TABLE 10-continued

| Example | Electro-photographic photosensitive member | Leakage: At starting of paper-feeding test | Leakage: After completion of image output on 1500 sheets | Leakage: After completion of image output on 3000 sheets | Variation amount in potential [V]: ΔVd | Variation amount in potential [V]: ΔVl |
|---|---|---|---|---|---|---|
| 10 | 10 | A | A | A | +10 | +15 |
| 11 | 11 | A | A | A | +8 | +10 |
| 12 | 12 | A | A | B | +10 | +15 |
| 13 | 13 | A | A | A | +10 | +15 |
| 14 | 14 | A | A | A | +10 | +15 |
| 15 | 15 | A | A | B | +10 | +15 |
| 16 | 16 | A | A | A | +10 | +15 |
| 17 | 17 | A | A | A | +10 | +15 |
| 18 | 18 | A | A | A | +10 | +25 |
| 19 | 19 | A | A | A | +10 | +25 |
| 20 | 20 | A | A | A | +15 | +30 |
| 21 | 21 | A | A | A | +15 | +30 |
| 22 | 22 | A | B | B | +15 | +30 |
| 23 | 23 | A | A | A | +10 | +15 |
| 24 | 24 | A | A | A | +8 | +10 |
| 25 | 25 | A | A | A | +8 | +10 |
| 26 | 26 | A | A | A | +10 | +20 |
| 27 | 27 | A | A | A | +10 | +20 |
| 28 | 28 | A | A | A | +10 | +15 |
| 29 | 29 | A | A | A | +8 | +10 |
| 30 | 30 | A | A | B | +10 | +15 |
| 31 | 31 | A | A | A | +10 | +15 |
| 32 | 32 | A | A | A | +10 | +15 |
| 33 | 33 | A | A | B | +10 | +15 |
| 34 | 34 | A | A | A | +10 | +15 |
| 35 | 35 | A | A | A | +10 | +15 |
| 36 | 36 | A | A | A | +10 | +25 |
| 37 | 37 | A | A | A | +10 | +25 |
| 38 | 38 | A | A | A | +15 | +30 |
| 39 | 39 | A | A | A | +15 | +30 |
| 40 | 40 | A | B | B | +15 | +30 |
| 41 | 41 | A | A | A | +10 | +15 |
| 42 | 42 | A | A | A | +8 | +10 |
| 43 | 43 | A | A | A | +8 | +10 |
| 44 | 44 | A | A | A | +10 | +20 |
| 45 | 45 | A | A | A | +10 | +20 |
| 46 | 46 | A | A | A | +10 | +15 |
| 47 | 47 | A | A | A | +8 | +10 |
| 48 | 48 | A | A | B | +10 | +15 |
| 49 | 49 | A | A | A | +10 | +15 |
| 50 | 50 | A | A | A | +10 | +15 |
| 51 | 51 | A | A | B | +10 | +15 |
| 52 | 52 | A | A | A | +10 | +15 |
| 53 | 53 | A | A | A | +10 | +15 |
| 54 | 54 | A | A | A | +10 | +25 |
| 55 | 55 | A | B | B | +20 | +35 |
| 56 | 56 | A | A | A | +10 | +20 |
| 57 | 57 | A | A | A | +10 | +20 |
| 58 | 58 | A | A | A | +10 | +15 |
| 59 | 59 | A | A | A | +10 | +20 |
| 60 | 60 | A | A | A | +10 | +20 |
| 61 | 61 | A | A | A | +10 | +15 |
| 62 | 62 | A | A | A | +10 | +15 |
| 63 | 63 | A | A | B | +10 | +20 |
| 64 | 64 | A | A | A | +10 | +20 |
| 65 | 65 | A | A | A | +10 | +20 |
| 66 | 66 | A | A | B | +10 | +20 |
| 67 | 67 | A | B | B | +20 | +35 |
| 68 | 68 | A | A | A | +10 | +20 |
| 69 | 69 | A | A | A | +10 | +20 |
| 70 | 70 | A | A | A | +10 | +15 |
| 71 | 71 | A | A | A | +10 | +20 |
| 72 | 72 | A | A | A | +10 | +20 |
| 73 | 73 | A | A | A | +10 | +15 |
| 74 | 74 | A | A | A | +10 | +15 |
| 75 | 75 | A | A | B | +10 | +20 |
| 76 | 76 | A | A | A | +10 | +20 |
| 77 | 77 | A | A | A | +10 | +20 |
| 78 | 78 | A | A | B | +10 | +20 |
| 79 | 79 | A | B | B | +20 | +35 |
| 80 | 80 | A | A | A | +10 | +20 |

TABLE 10-continued

| Example | Electro-photographic photosensitive member | Leakage: At starting of paper-feeding test | Leakage: After completion of image output on 1500 sheets | Leakage: After completion of image output on 3000 sheets | Variation amount in potential [V]: ΔVd | Variation amount in potential [V]: ΔVl |
|---|---|---|---|---|---|---|
| 81 | 81 | A | A | A | +10 | +20 |
| 82 | 82 | A | A | A | +10 | +15 |
| 83 | 83 | A | A | A | +10 | +20 |
| 84 | 84 | A | A | A | +10 | +20 |
| 85 | 85 | A | A | A | +10 | +15 |
| 86 | 86 | A | A | A | +10 | +15 |
| 87 | 87 | A | A | B | +10 | +20 |
| 88 | 88 | A | A | A | +10 | +20 |
| 89 | 89 | A | A | A | +10 | +20 |
| 90 | 90 | A | A | B | +10 | +20 |
| 91 | 91 | A | B | B | +10 | +35 |
| 92 | 92 | A | A | A | +10 | +25 |
| 93 | 93 | A | A | A | +10 | +25 |
| 94 | 94 | A | A | A | +10 | +20 |
| 95 | 95 | A | A | A | +10 | +25 |
| 96 | 96 | A | A | A | +15 | +30 |
| 97 | 97 | A | A | A | +15 | +20 |
| 98 | 98 | A | A | A | +15 | +20 |
| 99 | 99 | A | B | B | +10 | +25 |
| 100 | 100 | A | A | A | +10 | +25 |
| 101 | 101 | A | A | A | +10 | +25 |
| 102 | 102 | A | B | B | +10 | +25 |
| 103 | 103 | A | B | B | +10 | +35 |
| 104 | 104 | A | A | A | +10 | +30 |
| 105 | 105 | A | A | A | +10 | +30 |
| 106 | 106 | A | A | A | +10 | +25 |
| 107 | 107 | A | A | A | +10 | +30 |
| 108 | 108 | A | A | A | +15 | +35 |
| 109 | 109 | A | A | A | +15 | +25 |
| 110 | 110 | A | A | A | +15 | +25 |
| 111 | 111 | A | B | B | +10 | +30 |
| 112 | 112 | A | A | A | +10 | +30 |
| 113 | 113 | A | A | A | +10 | +30 |
| 114 | 114 | A | B | B | +10 | +30 |
| 115 | 115 | A | A | A | +10 | +20 |

TABLE 11

| Comparative Example | Electro-photographic photosensitive member | Leakage: At starting of paper-feeding test | Leakage: After completion of image output on 1500 sheets | Leakage: After completion of image output on 3000 sheets | Variation amount in potential [V]: ΔVd | Variation amount in potential [V]: ΔVl |
|---|---|---|---|---|---|---|
| 1 | C1 | A | A | A | +15 | +50 |
| 2 | C2 | B | B | B | +10 | +10 |
| 3 | C3 | C | C | C | +10 | +15 |
| 4 | C4 | B | C | C | +10 | +15 |
| 5 | C5 | C | C | C | +10 | +10 |
| 6 | C6 | A | A | A | +15 | +55 |
| 7 | C7 | A | A | A | +15 | +45 |
| 8 | C8 | B | C | C | +10 | +15 |
| 9 | C9 | A | A | A | +10 | +50 |
| 10 | C10 | A | A | A | +15 | +55 |
| 11 | C11 | B | B | C | +10 | +10 |
| 12 | C12 | C | C | D | +10 | +15 |
| 13 | C13 | C | C | C | +10 | +15 |
| 14 | C14 | C | C | D | +10 | +10 |
| 15 | C15 | A | A | A | +15 | +60 |
| 16 | C16 | A | A | A | +15 | +50 |
| 17 | C17 | C | C | C | +10 | +15 |
| 18 | C18 | A | A | A | +10 | +55 |
| 19 | C19 | A | A | A | +15 | +50 |
| 20 | C20 | B | B | B | +10 | +10 |
| 21 | C21 | C | C | C | +10 | +15 |

TABLE 11-continued

| Comparative Example | Electro-photographic photosensitive member | Leakage: At starting of paper-feeding test | Leakage: After completion of image output on 1500 sheets | Leakage: After completion of image output on 3000 sheets | Variation amount in potential [V]: ΔVd | Variation amount in potential [V]: ΔVl |
|---|---|---|---|---|---|---|
| 22 | C22 | B | C | C | +10 | +15 |
| 23 | C23 | C | C | C | +10 | +10 |
| 24 | C24 | A | A | A | +15 | +55 |
| 25 | C25 | A | A | A | +15 | +45 |
| 26 | C26 | B | C | C | +10 | +15 |
| 27 | C27 | A | A | A | +10 | +50 |
| 28 | C28 | A | A | A | +15 | +55 |
| 29 | C29 | B | B | C | +10 | +10 |
| 30 | C30 | C | C | D | +10 | +15 |
| 31 | C31 | C | C | C | +10 | +15 |
| 32 | C32 | C | C | D | +10 | +10 |
| 33 | C33 | A | A | A | +15 | +60 |
| 34 | C34 | A | A | A | +15 | +50 |
| 35 | C35 | C | C | C | +10 | +15 |
| 36 | C36 | A | A | A | +10 | +55 |
| 37 | C37 | A | A | A | +15 | +50 |
| 38 | C38 | B | B | B | +10 | +10 |
| 39 | C39 | C | C | C | +10 | +15 |
| 40 | C40 | B | C | C | +10 | +15 |
| 41 | C41 | C | C | C | +10 | +10 |
| 42 | C42 | A | A | A | +15 | +55 |
| 43 | C43 | A | A | A | +15 | +45 |
| 44 | C44 | B | C | C | +10 | +15 |
| 45 | C45 | A | A | A | +10 | +50 |
| 46 | C46 | A | A | A | +15 | +55 |
| 47 | C47 | B | B | C | +10 | +10 |
| 48 | C48 | C | C | D | +10 | +15 |
| 49 | C49 | C | C | C | +10 | +15 |
| 50 | C50 | C | C | D | +10 | +10 |
| 51 | C51 | A | A | A | +15 | +60 |
| 52 | C52 | A | A | A | +15 | +50 |
| 53 | C53 | C | C | C | +10 | +15 |
| 54 | C54 | A | A | A | +10 | +55 |
| 55 | C55 | A | A | A | +15 | +55 |
| 56 | C56 | B | B | C | +10 | +10 |
| 57 | C57 | C | C | D | +10 | +15 |
| 58 | C58 | C | C | C | +10 | +15 |
| 59 | C59 | C | C | D | +10 | +10 |
| 60 | C60 | A | A | A | +15 | +60 |
| 61 | C61 | A | A | A | +15 | +50 |
| 62 | C62 | C | C | C | +10 | +15 |
| 63 | C63 | A | A | A | +10 | +55 |
| 64 | C64 | A | A | A | +15 | +60 |
| 65 | C65 | B | C | C | +10 | +10 |
| 66 | C66 | C | D | D | +10 | +15 |
| 67 | C67 | C | C | D | +10 | +15 |
| 68 | C68 | C | D | D | +10 | +10 |
| 69 | C69 | A | A | A | +15 | +65 |
| 70 | C70 | A | A | A | +15 | +55 |
| 71 | C71 | C | C | D | +10 | +15 |
| 72 | C72 | A | A | A | +10 | +60 |
| 73 | C73 | B | B | B | +10 | +20 |
| 74 | C74 | B | B | B | +10 | +20 |
| 75 | C75 | B | B | B | +10 | +20 |
| 76 | C76 | E | E | E | +8 | +10 |
| 77 | C77 | D | E | E | +8 | +10 |
| 78 | C78 | A | A | A | +20 | +100 |
| 79 | C79 | A | A | A | +20 | +100 |
| 80 | C80 | C | C | D | +10 | +20 |
| 81 | C81 | C | D | D | +10 | +20 |
| 82 | C82 | C | D | D | +10 | +20 |
| 83 | C83 | C | D | D | +10 | +20 |

(Needle Breakdown Voltage Test of Electrophotographic Photosensitive Member)

Electrophotographic photosensitive members 116 to 230 and C84 to C166 for needle breakdown voltage test were subjected to the following needle breakdown voltage test.

Figure 2:
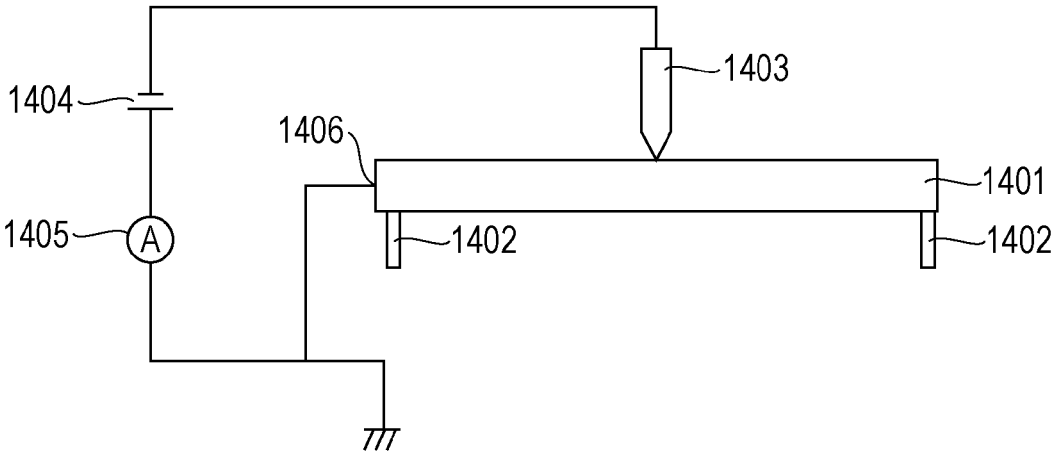
FIG. 2 is a diagram illustrating an example of a needle breakdown voltage tester.

FIG. 2 shows a needle breakdown voltage tester. The needle breakdown voltage test was conducted in an ordinary temperature and ordinary humidity (23° C./50% RH) environment.

An electrophotographic photosensitive member 1401 was placed on a fixing table 1402 and was fixed at both ends so that it will not move. The tip of a needle electrode 1403 was brought into contact with the surface of the electrophotographic photosensitive member 1401. The needle electrode 1403 was connected to a power source 1404 for applying a voltage to the needle electrode 1403 and connected to an ammeter 1405 for measuring an electric current. A portion 1406 of the electrophotographic photosensitive member 1401 being in contact with the support was earth-connected. The voltage applied from the needle electrode 1403 was increased from 0 V by 10 V per every 2 seconds to cause current leakage inside the electrophotographic photosensitive member 1401 being in contact with the tip of the needle electrode 1403. The voltage at which the amperage measured with the ammeter 1405 was 10 times or more the amperage at the voltage applied immediately before (the voltage lower than the needle breakdown voltage value by 10 V) was defined as a needle breakdown voltage value. This measurement was conducted at five different points of the surface of the electrophotographic photosensitive member 1401, and the average value was defined as the needle breakdown voltage value of the measuring object, the electrophotographic photosensitive member 1401. The results are shown in Tables 12 and 13.

TABLE 12

| Example | Electro-photographic photosensitive member | Needle breakdown voltage [−V] |
|---|---|---|
| 1 | 116 | 4500 |
| 2 | 117 | 4500 |
| 3 | 118 | 4500 |
| 4 | 119 | 3500 |
| 5 | 120 | 4100 |
| 6 | 121 | 4000 |
| 7 | 122 | 4000 |
| 8 | 123 | 4100 |
| 9 | 124 | 4100 |
| 10 | 125 | 4100 |
| 11 | 126 | 4000 |
| 12 | 127 | 3900 |
| 13 | 128 | 4100 |
| 14 | 129 | 4000 |
| 15 | 130 | 3900 |
| 16 | 131 | 4000 |
| 17 | 132 | 4000 |
| 18 | 133 | 4200 |
| 19 | 134 | 4500 |
| 20 | 135 | 4500 |
| 21 | 136 | 4500 |
| 22 | 137 | 3500 |
| 23 | 138 | 4100 |
| 24 | 139 | 4000 |
| 25 | 140 | 4000 |
| 26 | 141 | 4100 |
| 27 | 142 | 4100 |
| 28 | 143 | 4100 |
| 29 | 144 | 4000 |
| 30 | 145 | 3900 |
| 31 | 146 | 4100 |
| 32 | 147 | 4000 |
| 33 | 148 | 3900 |
| 34 | 149 | 4000 |
| 35 | 150 | 4000 |
| 36 | 151 | 4200 |
| 37 | 152 | 4500 |
| 38 | 153 | 4500 |
| 39 | 154 | 4500 |
| 40 | 155 | 3500 |
| 41 | 156 | 4100 |
| 42 | 157 | 4000 |
| 43 | 158 | 4000 |
| 44 | 159 | 4100 |
| 45 | 160 | 4100 |

TABLE 12-continued

| Example | Electro-photographic photosensitive member | Needle breakdown voltage [−V] |
|---|---|---|
| 46 | 161 | 4100 |
| 47 | 162 | 4000 |
| 48 | 163 | 3900 |
| 49 | 164 | 4100 |
| 50 | 165 | 4000 |
| 51 | 166 | 3900 |
| 52 | 167 | 4000 |
| 53 | 168 | 4000 |
| 54 | 169 | 4200 |
| 55 | 170 | 3400 |
| 56 | 171 | 3900 |
| 57 | 172 | 3900 |
| 58 | 173 | 3800 |
| 59 | 174 | 3900 |
| 60 | 175 | 3900 |
| 61 | 176 | 3800 |
| 62 | 177 | 3800 |
| 63 | 178 | 3700 |
| 64 | 179 | 3900 |
| 65 | 180 | 3900 |
| 66 | 181 | 3700 |
| 67 | 182 | 3400 |
| 68 | 183 | 3900 |
| 69 | 184 | 3900 |
| 70 | 185 | 3800 |
| 71 | 186 | 3900 |
| 72 | 187 | 3900 |
| 73 | 188 | 3800 |
| 74 | 189 | 3800 |
| 75 | 190 | 3700 |
| 76 | 191 | 3900 |
| 77 | 192 | 3900 |
| 78 | 193 | 3700 |
| 79 | 194 | 3400 |
| 80 | 195 | 3900 |
| 81 | 196 | 3900 |
| 82 | 197 | 3800 |
| 83 | 198 | 3900 |
| 84 | 199 | 3900 |
| 85 | 200 | 3800 |
| 86 | 201 | 3800 |
| 87 | 202 | 3700 |
| 88 | 203 | 3900 |
| 89 | 204 | 3900 |
| 90 | 205 | 3700 |
| 91 | 206 | 3300 |
| 92 | 207 | 3800 |
| 93 | 208 | 3800 |
| 94 | 209 | 3700 |
| 95 | 210 | 3800 |
| 96 | 211 | 3900 |
| 97 | 212 | 3700 |
| 98 | 213 | 3700 |
| 99 | 214 | 3300 |
| 100 | 215 | 3800 |
| 101 | 216 | 3800 |
| 102 | 217 | 3300 |
| 103 | 218 | 3200 |
| 104 | 219 | 3700 |
| 105 | 220 | 3700 |
| 106 | 221 | 3600 |
| 107 | 222 | 3700 |
| 108 | 223 | 3800 |
| 109 | 224 | 3600 |
| 110 | 225 | 3600 |
| 111 | 226 | 3200 |
| 112 | 227 | 3700 |
| 113 | 228 | 3700 |
| 114 | 229 | 3200 |
| 115 | 230 | 4000 |

TABLE 13

| Comparative Example | Electro-photographic photosensitive member | Needle breakdown voltage [−V] |
|---|---|---|
| 1 | C84 | 4500 |
| 2 | C85 | 3000 |
| 3 | C86 | 1500 |
| 4 | C87 | 2000 |
| 5 | C88 | 1500 |
| 6 | C89 | 4100 |
| 7 | C90 | 4000 |
| 8 | C91 | 2000 |
| 9 | C92 | 4100 |
| 10 | C93 | 4400 |
| 11 | C94 | 2900 |
| 12 | C95 | 1400 |
| 13 | C96 | 1900 |
| 14 | C97 | 1400 |
| 15 | C98 | 4000 |
| 16 | C99 | 3900 |
| 17 | C100 | 1900 |
| 18 | C101 | 4000 |
| 19 | C102 | 4500 |
| 20 | C103 | 3000 |
| 21 | C104 | 1500 |
| 22 | C105 | 2000 |
| 23 | C106 | 1500 |
| 24 | C107 | 4100 |
| 25 | C108 | 4000 |
| 26 | C109 | 2000 |
| 27 | C110 | 4100 |
| 28 | C111 | 4400 |
| 29 | C112 | 2900 |
| 30 | C113 | 1400 |
| 31 | C114 | 1900 |
| 32 | C115 | 1400 |
| 33 | C116 | 4000 |
| 34 | C117 | 3900 |
| 35 | C118 | 1900 |
| 36 | C119 | 4000 |
| 37 | C120 | 4500 |
| 38 | C121 | 3000 |
| 39 | C122 | 1500 |
| 40 | C123 | 2000 |
| 41 | C124 | 1500 |
| 42 | C125 | 4100 |
| 43 | C126 | 4000 |
| 44 | C127 | 2000 |
| 45 | C128 | 4100 |
| 46 | C129 | 4400 |
| 47 | C130 | 2900 |
| 48 | C131 | 1400 |
| 49 | C132 | 1900 |
| 50 | C133 | 1400 |
| 51 | C134 | 4000 |
| 52 | C135 | 3900 |
| 53 | C136 | 1900 |
| 54 | C137 | 4000 |
| 55 | C138 | 4300 |
| 56 | C139 | 2800 |
| 57 | C140 | 1300 |
| 58 | C141 | 1800 |
| 59 | C142 | 1300 |
| 60 | C143 | 3900 |
| 61 | C144 | 3800 |
| 62 | C145 | 1800 |
| 63 | C146 | 3900 |
| 64 | C147 | 4200 |
| 65 | C148 | 2700 |
| 66 | C149 | 1200 |
| 67 | C150 | 1700 |
| 68 | C151 | 1200 |
| 69 | C152 | 3800 |
| 70 | C153 | 3700 |
| 71 | C154 | 1700 |
| 72 | C155 | 3800 |
| 73 | C156 | 3000 |
| 74 | C157 | 3000 |
| 75 | C158 | 3000 |

TABLE 13-continued

| Comparative Example | Electro-photographic photosensitive member | Needle breakdown voltage [−V] |
|---|---|---|
| 76 | C159 | 500 |
| 77 | C160 | 800 |
| 78 | C161 | 4600 |
| 79 | C162 | 4600 |
| 80 | C163 | 1200 |
| 81 | C164 | 1000 |
| 82 | C165 | 1000 |
| 83 | C166 | 1000 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-033340 filed Feb. 24, 2014 and No. 2015-019188 filed Feb. 3, 2015, which are hereby incorporated by reference herein in their entirety.

What is claimed is:

1. An electrophotographic photosensitive member comprising:

a support;

a conductive layer on the support; and a photosensitive layer on the conductive layer, wherein the conductive layer comprises a binder material, a first particle, and a second particle;

the first particle is composed of a core particle coated with aluminum-doped zinc oxide;

the second particle is composed of the same material as that of the core particle of the first particle and is not coated with an inorganic material or an organic material;

a content of the first particle in the conductive layer is 20% by volume or more and 50% by volume or less based on a total volume of the conductive layer; and a content of the second particle in the conductive layer is 0.1% by volume or more and 15% by volume or less based on the total volume of the conductive layer, and 0.5% by volume or more and 30% by volume or less based on the volume of the first particle in the conductive layer.

2. The electrophotographic photosensitive member according to claim 1, wherein the core particle of the first particle and the second particle are titanium oxide particles.

3. The electrophotographic photosensitive member according to claim 1, wherein the core particle of the first particle and the second particle are zinc oxide particles.

4. The electrophotographic photosensitive member according to claim 1, wherein the core particle of the first particle and the second particle are tin oxide particles.

5. The electrophotographic photosensitive member according to claim 1, wherein the content of the second particle in the conductive layer is 1% by volume or more and 20% by volume or less based on the volume of the first particle.

6. The electrophotographic photosensitive member according to claim 1, wherein the first particle and the second particle in the conductive layer respectively have an average primary particle diameter (D1) and an average primary particle diameter (D2), and a ratio (D1/D2) of the average primary particle diameter D1 to the average primary particle diameter D2 is 0.7 or more and 1.3 or less.

7. The electrophotographic photosensitive member according to claim 1, wherein the binder material is a curable resin.

8. The electrophotographic photosensitive member according to claim 1, wherein the first particle has an average primary particle diameter (D1) of 0.10 μm or more and 0.45 μm or less.

9. The electrophotographic photosensitive member according to claim 1, wherein the conductive layer has a volume resistivity of $1.0\times10^{8}$ Ω·cm or more and $5.0\times10^{12}$ Ω·cm or less.

10. A process cartridge integrally supporting the electrophotographic photosensitive member according to claim 1 and at least one selected from the group consisting of charging devices, developing devices, and cleaning devices and being detachably attachable to an electrophotographic apparatus main body.

11. An electrophotographic apparatus comprising the electrophotographic photosensitive member according to claim 1, a charging device, an exposing device, a developing device, and a transferring device.

12. An electrophotographic photosensitive member comprising:

a support;

a conductive layer on the support; and a photosensitive layer on the conductive layer, wherein the conductive layer comprises a binder material, a first particle, and a second particle;

the first particle is composed of a core particle coated with oxygen-deficient zinc oxide;

the second particle is composed of the same material as that of the core particle of the first particle and is not coated with an inorganic material or an organic material;

a content of the first particle in the conductive layer is 20% by volume or more and 50% by volume or less based on a total volume of the conductive layer; and a content of the second particle in the conductive layer is 0.1% by volume or more and 15% by volume or less based on the total volume of the conductive layer, and 0.5% by volume or more and 30% by volume or less based on the volume of the first particle in the conductive layer.

13. The electrophotographic photosensitive member according to claim 12, wherein the core particle of the first particle and the second particle are titanium oxide particles.

14. The electrophotographic photosensitive member according to claim 12, wherein the core particle of the first particle and the second particle are zinc oxide particles.

15. The electrophotographic photosensitive member according to claim 12, wherein the core particle of the first particle and the second particle are tin oxide particles.

16. The electrophotographic photosensitive member according to claim 12, wherein the content of the second particle in the conductive layer is 1% by volume or more and 20% by volume or less based on the volume of the first particle.

17. The electrophotographic photosensitive member according to claim 12, wherein the first particle and the second particle in the conductive layer respectively have an average primary particle diameter (D1) and an average primary particle diameter (D2), and a ratio (D1/D2) of the average primary particle diameter D1 to the average primary particle diameter D2 is 0.7 or more and 1.3 or less.

18. The electrophotographic photosensitive member according to claim 12, wherein the binder material is a curable resin.

19. The electrophotographic photosensitive member according to claim 12, wherein the first particle has an average primary particle diameter (D1) of 0.10 μm or more and 0.45 μm or less.

20. The electrophotographic photosensitive member according to claim 12, wherein the conductive layer has a volume resistivity of $1.0\times10^{8}$ Ω·cm or more and $5.0\times10^{12}$ Ω·cm or less.

21. A process cartridge integrally supporting the electrophotographic photosensitive member according to claim 12 and at least one selected from the group consisting of charging devices, developing devices, and cleaning devices and being detachably attachable to an electrophotographic apparatus main body.

22. An electrophotographic apparatus comprising the electrophotographic photosensitive member according to claim 12, a charging device, an exposing device, a developing device, and a transferring device.

* * * * *